United States Patent [19]

Goi

[11] Patent Number: 5,059,153

[45] **Date of Patent: * Oct. 22, 1991**

[54] COIN RECEIVING AND DISPENSING MACHINE

[75] Inventor: Kouichi Goi, Kawasaki, Japan

[73] Assignee: Laurel Bank Machines Co., Ltd., Tokyo, Japan

[ * ] Notice: The portion of the term of this patent subsequent to Jun. 4, 2008 has been disclaimed.

[21] Appl. No.: 381,314

[22] Filed: Jul. 18, 1989

[30] Foreign Application Priority Data

Jul. 22, 1988 [JP] Japan ..... 63-183270
Jul. 4, 1989 [JP] Japan ..... 1-172645

[51] Int. Cl.[5] ..... G07D 3/02; G07D 3/16

[52] U.S. Cl. ..... 453/11; 453/17; 453/40; 453/49

[58] Field of Search ..... 453/3, 11, 16, 17, 40, 453/49, 52; 194/346

[56] References Cited

U.S. PATENT DOCUMENTS 3,971,393 7/1976 Akai et al. ..... 453/17
4,286,703 9/1981 Schuller et al. ..... 194/346 X
4,558,661 12/1985 Sentoku et al. .
4,635,661 1/1987 Uematsu et al. .
4,687,089 8/1987 Wuethrich ..... 194/346 X

FOREIGN PATENT DOCUMENTS 61-60195 3/1986 Japan .
62-6396 1/1987 Japan .

*Primary Examiner*—F. J. Bartuska
*Attorney, Agent, or Firm*—Fleit, Jacobson, Cohn, Price, Holman & Stern

[57] ABSTRACT

A coin receiving and dispensing machine comprising a discriminating and counting sensor for discriminating at least the denominations and genuineness of deposited coins and counting their value, a coin sorter for sorting the deposited coins in accordance their denominations, a plurality of temporary storing cylinders for receiving the coins sorted by the coin sorter from an upper opening thereof and temporarily storing the received coins as stacked separately in accordance with their denominations and a plurality of dispensing coin storing cylinders for receiving and storing the coins stored in the plurality of temporary storing cylinders as dispensing coins separately in accordance with their denominations, the coin receiving and dispensing machine further including a coin collector for, in the case where it is judged based upon the result of the discrimination and counting made by the discriminating and counting sensor that at least one of the dispensing coin storing cylinders is full of coins, collecting the coins that would normally be stored in the dispensing coin storing cylinder, the coin collector being disposed between the discriminating and counting sensor and the coin sorter. This machine can effectively prevent the coins from jamming and being erroneously sorted.

8 Claims, 13 Drawing Sheets

COIN RECEIVING AND DISPENSING MACHINE

BACKGROUND OF THE INVENTION

The present invention relates to a coin receiving and dispensing machine, and, more particularly, to a circulation-type coin receiving and dispensing machine capable of dispensing received coins.

DESCRIPTION OF THE PRIOR ART

Unexamined Japanese Patent Publication No. 61(1986)-60195 proposes a circulation-type coin receiving and dispensing machine capable of dispensing received coins. In this coin receiving and dispensing machine, the denominations and genuineness etc. of received coins are discriminated to reject counterfeit coins and the genuine coins are fed to a coin sorting section to be sorted based upon their diameters and are stored in a temporary storing section in accordance with their denominations. Then, in the case where instructions that the stored coins should be accepted are input, shutters disposed at the bottom of the temporary storing sections are opened and the coins stored in the temporary storing sections are fed to a dispensing coin storing section disposed below the temporary storing section in accordance with their denominations and stored therein as coins for dispensation. Further, when instructions that coins should be dispensed are input, the coins stored in the dispensing coin storing sections are dispensed. In this machine, coin collecting means are provided above the temporary storing sections and in the case where at least one of the dispensing coin storing sections is full of coins, the coins sorted in accordance with their denominations are collected by the coin collecting means into a coin collecting section irrespectively of their denominations.

Further, unexamined Japanese Patent Publication No. 62(1987)-6396 proposes a circulation-type coin receiving and dispensing machine. In this coin receiving and dispensing machine, the denominations and genuineness etc. of received coins are discriminated to reject counterfeit coins and the genuine coins are fed to a coin sorting section and are stored in temporary storing sections by opening or closing gates in accordance their denominations. Then, in the case where instructions that the stored coins should be accepted are input, shutters disposed at the bottom of the temporary storing sections are opened and the coins stored in each of the temporary storing sections are fed to a dispensing coin storing section disposed below the temporary storing section in accordance with their denominations and stored therein as coins for dispensation. Further, when instructions that coins should be dispensed are input, the coins stored in the dispensing coin storing sections are dispensed. In this machine, coin collecting means are provided above the temporary storing sections and in the case where at least one of the dispensing coin storing sections is full of coins, the coin collecting means prevents the gate for the temporary storing section corresponding to the dispensing coin storing section which is full of coins from being operated, thereby to collect the coins to be stored in the dispensing coin storing section into a coin collecting section irrespective of their denominations.

In these coin receiving and dispensing machines, since it is unnecessary to provide separate coin receiving and coin dispensing machines and the received coins are used for dispensing coins, the efficiency of coin utilization can be improved.

However, in these machine, since all of the genuine coins are fed to a coin sorting section, including coins which should be collected because the dispensing coin storing section in which the coins are to be stored is full, there is some risk of the coins jamming in the coin sorting section or the coins being erroneously sorted. More specifically, in the machine disclosed in unexamined Japanese Patent Publication No. 61(1986)-60195, even if some dispensing coin storing sections are full of coins and some coins have to be collected because they cannot be stored in the dispensing coin storing sections, all of the genuine coins are fed to the coin sorting section and after they are sorted based upon their diameters, the coins which cannot be stored in the dispensing coin storing sections are collected. Therefore, there is a risk of the coins jamming in the coin sorting section and the coins being erroneously sorted, thereby to be stored in wrong temporary storing sections. On the other hand, in the machine disclosed in unexamined Japanese Patent Publication No. 62(1987)-6396, even if some dispensing coin storing sections are full of coins and some coins have to be collected because they cannot be stored in the dispensing coin storing sections, all of the genuine coins are fed to the coin sorting section and the gates for the temporary storing sections for storing coins to be stored in the dispensing coin storing sections that are full are not actuated so that the coins are collected. Therefore, there is a risk of the coins jamming in the coin sorting section and the coins being stored in wrong temporary storing sections if the gates are not actuated with predetermined timing. Further, in the case where the coins are erroneously sorted, since the coins are fed to the wrong temporary storing sections, the coins jam in the temporary storing sections, or even if the wrong coins do not jam in the temporary storing sections and are fed to the dispensing coin storing sections, the wrong coins will be dispensed from the dispensing coin storing sections.

SUMMARY OF THE INVENTION

It is, therefore, an object of the present invention to provide a coin receiving and dispensing machine capable of effectively preventing the coins from jamming and being erroneously sorted.

According to the present invention, the above and other objects can be accomplished by a coin receiving and dispensing machine comprising discriminating and counting means for discriminating at least the denominations and genuiness of deposited coins and counting their value, coin sorting means for sorting the deposited coins in accordance their denominations, a plurality of temporary storing means for receiving the coins sorted by said coin sorting means in accordance with their denominations from an upper opening thereof and temporarily storing the received coins as stacked separately in accordance with their denominations and a plurality of dispensing coin storing means for receiving and storing the coins stored in said plurality of temporary storing means as dispensing coins separately in accordance with their denominations, said coin receiving and dispensing machine further comprising coin collecting means for, in the case where it is judged based upon the result of the discrimination and counting made by said discriminating and counting means that at least one of said dispensing coin storing means is full of coins, collecting the coins that would normally be stored in said dispensing coin storing means, said coin collecting means being disposed between said discriminating and counting means and said coin sorting means.

The above and other objects and features of the present invention will become apparent from the following description made with reference to the accompanying drawings.

DESCRIPTION OF THE PREFERRED EMBODIMENTS

Figure 1:
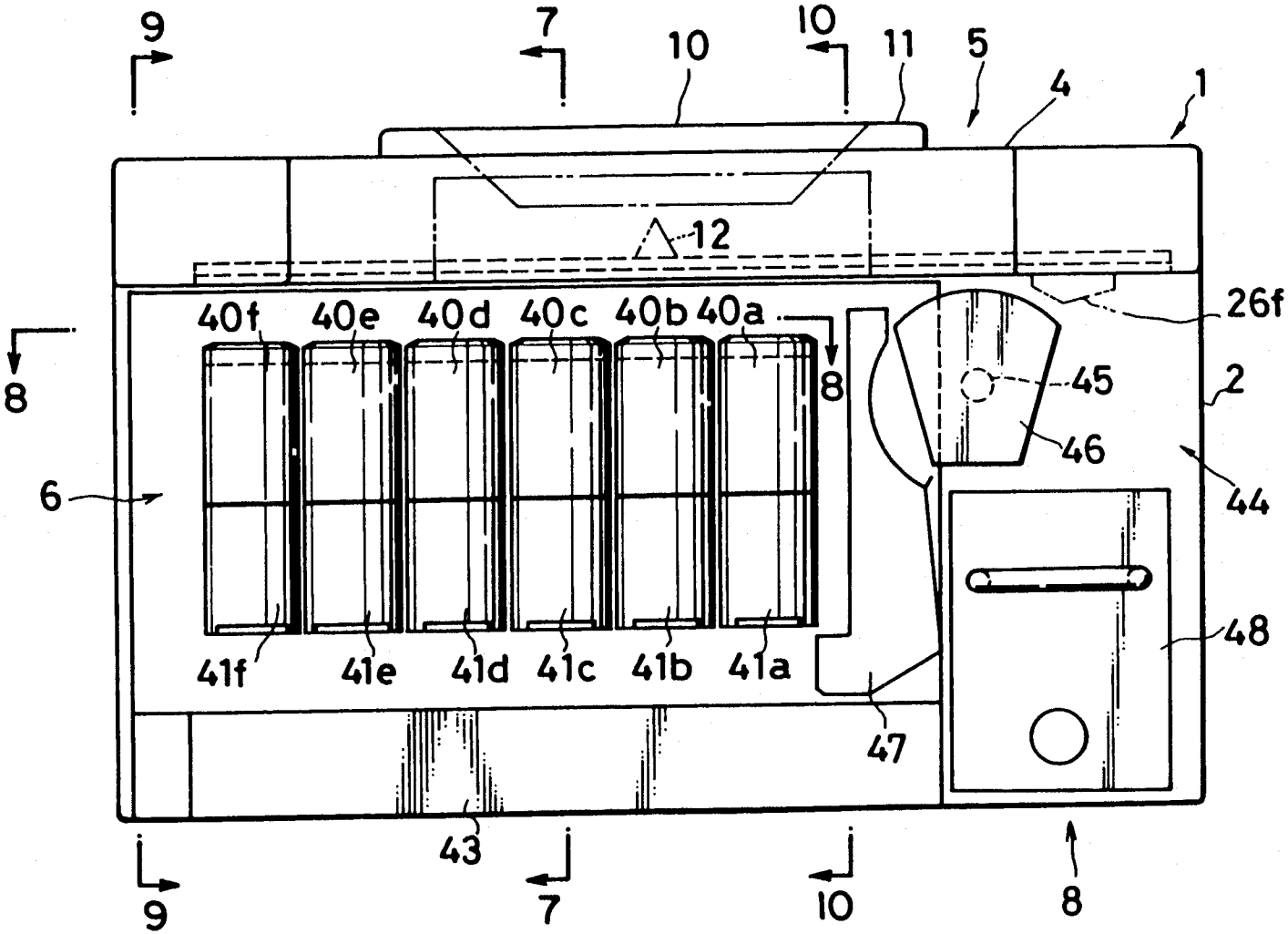
FIG. 1 is a schematic drawing showing a front view of a coin receiving and dispensing machine which is an embodiment of the present invention wherein a front door is removed.
Figure 2:
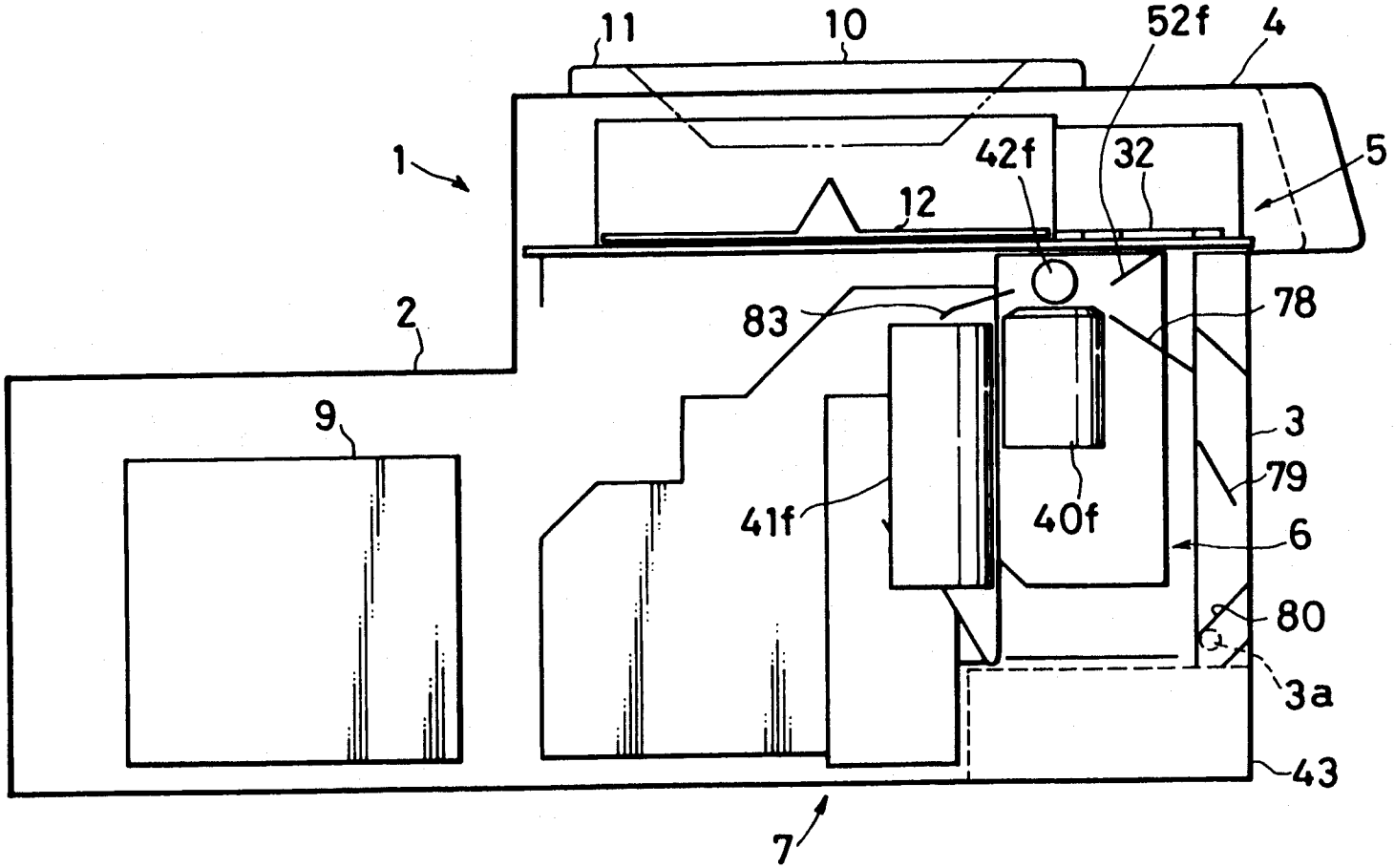
FIG. 2 is a schematic drawing showing a left side view of a coin receiving and dispensing machine which is an embodiment of the present invention wherein a part of the internal mechanism thereof is shown.

Referring to FIGS. 1 and 2, in a coin receiving and dispensing machine 1 which is an embodiment of the present invention, an internal mechanism is covered by a casing 2, a front door 3 and an upper cover 4. The internal mechanism comprises an upper mechanism 5 for receiving and discriminating coins, counting their value and separating them in accordance with their denominations, the upper mechanism 5 being covered by the upper cover 4 and being exposable by opening the upper cover 4, a front mechanism 6 disposed below the upper mechanism 5, a rear mechanism 7 disposed below the upper mechanism 6 and behind the front mechanism 6, a side mechanism 8 disposed at the left side of the front mechanism 6 in FIG. 1, a drive mechanism (not shown) which is disposed at a central location among the side mechanism 8, and the front mechanism 6 and the rear mechanism 7 for driving respective means provided in these three mechanisms, and a control mechanism 9 disposed behind the upper mechanism 5, the front mechanism 6, the rear mechanism 7, the side mechanism 8 and the drive mechanism for supplying power to respective means of these mechanisms and controlling these mechanisms. The front door 3 is secured to a pivot shaft 3*a* so as to be pivotable forwardly about the pivot shaft 3*a* and the front mechanism 6 can be exposed by pivoting the front door 3 forwardly about the pivot shaft 3*a*.

As shown in FIGS. 1 to 4, the upper mechanism 6 is provided with a hopper 11 formed with a coin deposit opening 10 at a central portion thereof and a rotatable disk 12 for receiving coins deposited through the coin deposit opening 10. A guide (not shown) is provided around the rotatable disk 12. The coins received by the disk 12 are fed to a take-in roller 13 by the centrifugal force produced by rotation of the disk 12, while being guided by the guide, and are further fed one by one to a coin discriminating and counting passage 14 having a substantially L-shape. The coins are held between a first transporting endless belt 16 engaged with pulleys 15*a*, 15*b* and an upper face of the coin discriminating and counting passage 14 and fed to a first turning portion 20 where the transporting direction of the coins is turned substantially perpendicularly. The coins are thereafter held between a second transporting endless belt 18 engaged with pulleys 17*a*, 17*b*, 17*c* and the upper face of the coin discriminating and counting passage 14 and fed to a second turning portion 21.

The first and second transporting endless belts 16 and 18 are driven at a higher rate than the circumferential speed of the take-in roller 13 to accelerate the transporting rate of the coins fed from the take-in roller 13 to the coin discriminating and counting passage 14. As a result, the distance between each coin and the one following it is increased, whereby the coins can be prevented from jamming.

One of a pair of guides 22 is provided on either sides of the coin discriminating and counting passage 14. On the coin discriminating and counting passage 14 below the first transporting endless belt 16, there is provided a discriminating and counting sensor 23 for discriminating the denominations and genuineness etc. of the coins based upon characteristics thereof such as material and diameter, and for counting their value. Further, there are provided a pair of first sensors 24 and a pair of second sensors 25 for judging whether or not the distance between each coin and the one following it greater than a predetermined value. At an end of the coin discriminating and counting passage 14 downstream of the second sensors 25, there is provided a gate 26 which is opened or closed in accordance with detection signals from the discriminating and counting sensor 23, the first sensors 24 and the second sensors 25. The gate 26 is normally closed so as to enable the coins to pass thereover. On the other hand, in the case where the discriminating and counting sensor 23 judges that a certain dispensation cylinder to be described later is full of coins, the gate 26 is opened when the second sensors 25 detect a coin to be stored in the dispensation cylinder concerned and the coin is collected into a coin collecting compartment described later. Further, in the case where the coin to be collected is too close to the one ahead of it or the one behind it for some reason, there is some risk that the preceding or following coin will be also collected if the gate 26 is opened when the second sensors 25 detect the coin to be collected. Therefore, the gate 26 is controlled such that when the following coin has been detected by the first sensors 24 at the time when the second sensors 25 detect the coin to be collected or when the preceding coin is detected by the second sensors 25 after the first sensors 24 detect the coin to be collected, the following coin or the preceding coin is collected via the gate 26 together with the coin to be collected. Further, in the case where the discriminating and counting sensor 23 discriminates the coin as counterfeit or it cannot discriminate the coin since it is foreign, a control unit (not shown) of the control mechanism 9 stops driving the first transporting endless belt 16 in accordance with a signal output from the discriminating and counting sensor 23, and the coin can be removed manually by removing the upper cover 4.

The coins which have passed over the gate 26 and have been fed to the second turning portion 21 are received by a third transporting endless belt 28 engaged with pulleys 27*a*, 27*b*, 27*c* and a fourth transporting endless belt 29 engaged with pulleys 27*a*, 27*b*, 27*c*, 27*d*, 27*e* after their transporting direction is turned substantially perpendicularly and are further transported in a coin sorting passage 32 by a fifth transporting endless belt 30 engaged with pulleys 27*c*, 27*d*, 27*e*, 27*f* and a sixth transporting endless belt 31 engaged with pulleys 27*f*, 27*g*.

Figure 3:
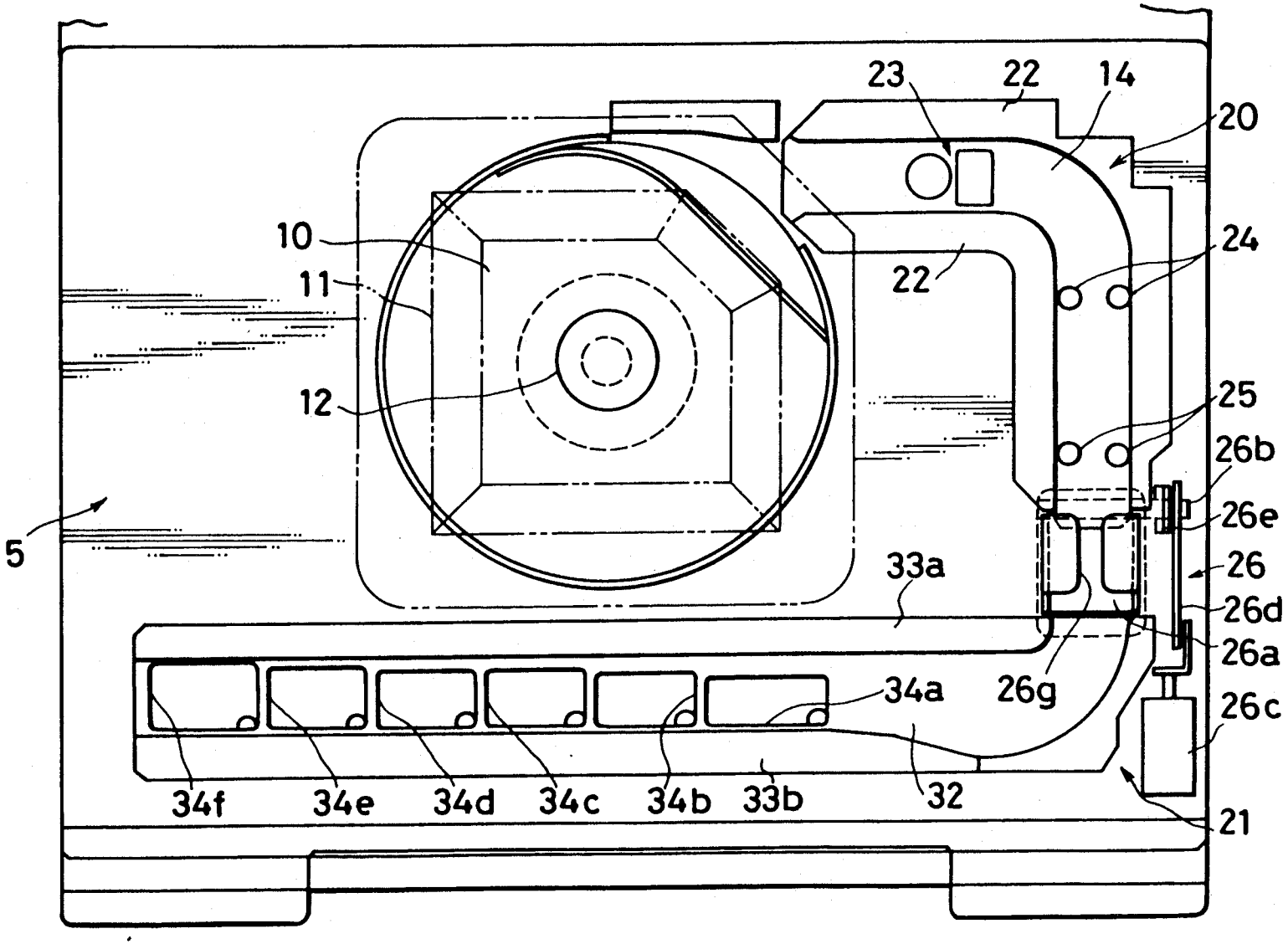
FIG. 3 is a schematic drawing showing a plan view of a coin receiving and dispensing machine which is an embodiment of the present invention wherein an upper cover is removed.
Figure 4:
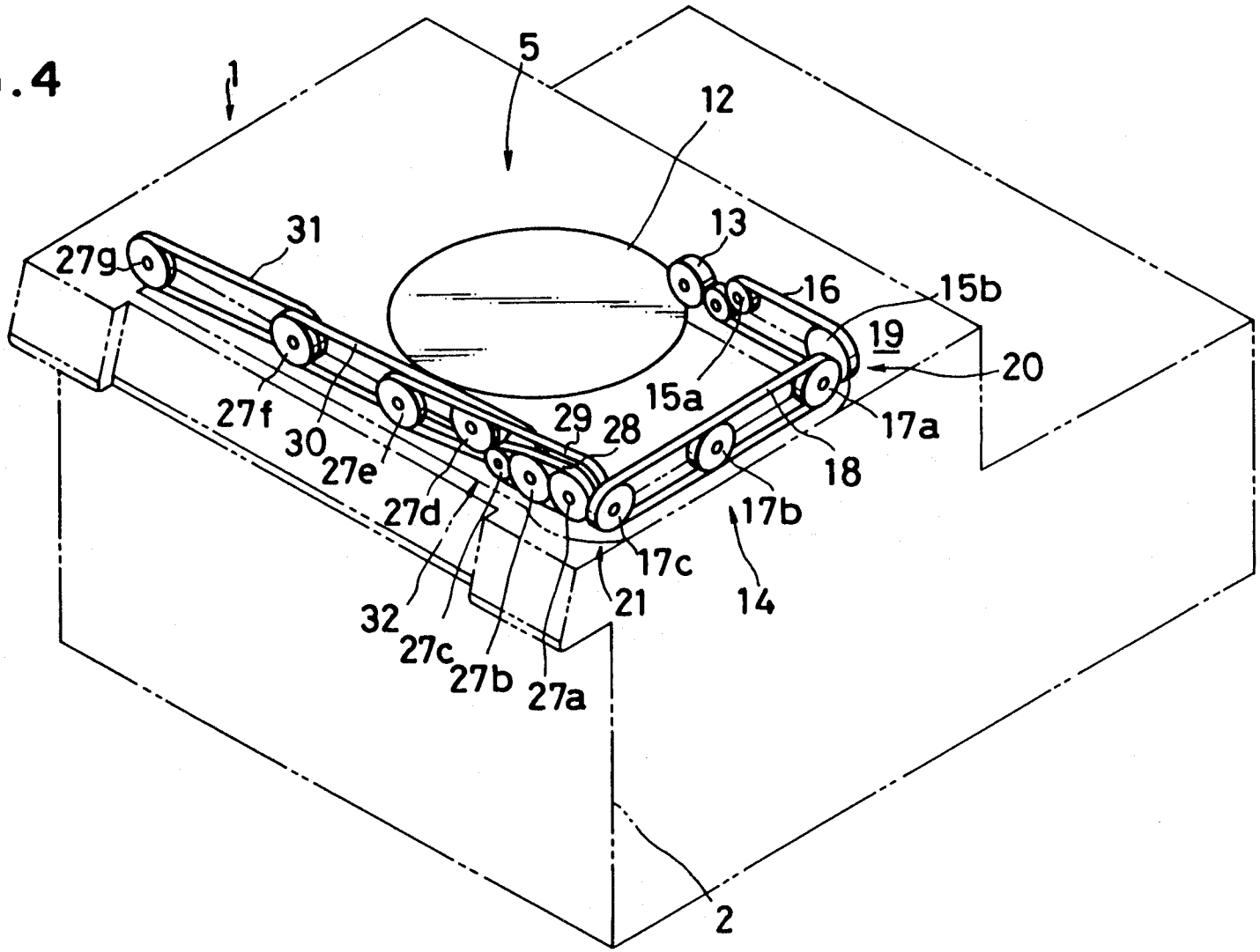
FIG. 4 is a schematic drawing showing a perspective view of a coin receiving and dispensing machine which is an embodiment of the present invention wherein an upper cover is removed.

As shown in FIG. 3, a pair of guides 33*a*, 33*b* are provided in the coin sorting passage 32 on the opposite sides thereof and coin separation openings are formed along the outer guide 33*b*, the number of the coin sorting openings being equal to the number of denominations of coins to be received and dispensed. In this embodiment, six coin sorting openings 34*a*, 34*b*, 34*c*, 34*d*, 34*e*, 34*f* are formed. The coin sorting openings 34*a*, 34*b*, 34*c*, 34*d*, 34*e*, 34*f* are formed in such a manner that the closer the coin sorting openings are, the smaller the width thereof is and the third, fourth, fifth and sixth transporting endless belts 28, 29, 30, 31 are driven so that the coins are transported along the outer guide 33*b* in the coin sorting passage 32. Accordingly, the coins fall into the coin sorting opening 34*a*, 34*b*, 34*c*, 34*d*, 34*e*, 34*f* in smaller diameter order without fail.

As shown in FIG. 1, below the coin sorting openings 34*a*, 34*b*, 34*c*, 34*d*, 34*e*, 34*f*, there are provided temporary storing cylinders 40*a*, 40*b*, 40*c*, 40*d*, 40*e*, 40*f*, each being for temporarily storing coins of a specific denomination different from the others. After all coins received by the coin receiving and dispensing machine 1 have been stored in the temporary storing cylinders 40*a*, 40*b*, 40*c*, 40*d*, 40*e*, 40*f*, the value of the received coins counted by the discriminating and counting sensor 23 is displayed on a display section (not shown).

When the operator judges that the coin receiving and dispensing machine 1 may accept the deposited coins, as where the displayed value agrees with that expected by the operator, the operator inputs a coin acceptance signal to an input section (not shown).

In the case where the coin acceptance signal is input to the coin receiving and dispensing machine 1 by the operator, the coins stored in the temporary storing cylinders 40*a*, 40*b*, 40*c*, 40*d*, 40*e*, 40*f* are fed by a take-out mechanism described later to dispensation cylinders 41*a*, 41*b*, 41*c*, 41*d*, 41*e*, 41*f* disposed behind the temporary storing cylinders 40*a*, 40*b*, 40*c*, 40*d*, 40*e*, 40*f* and are stored therein. In FIG. 2, the reference numeral 42*f* designates a take-out roller constituting a part of the take-out mechanism for taking out coins from the temporary storing cylinder 40*f* and feeding them to the dispensation cylinder 41*f* and there are shown only the temporary storing cylinder 40*f* and the dispensation cylinder 41*f* for storing coins of the same denomination as those stored in the temporary storing cylinder 40*f*.

On the other hand, in the case where the operator inputs a cancel instruction to the input section (not shown), such as when the displayed value of the coins does not agree with that expected by the operator, the coins stored in the temporary storing cylinders 40*a*, 40*b*, 40*c*, 40*d*, 40*e*, 40*f* are fed by the take-out mechanism described later to a coin dispensing compartment 43 provided in the front mechanism 6 and collected by the operator. The take-out roller 42*f* is also used for taking out the coins stored in the temporary storing cylinder 40*f* and feeding them to the coin dispensing compartment 43.

Figure 5:
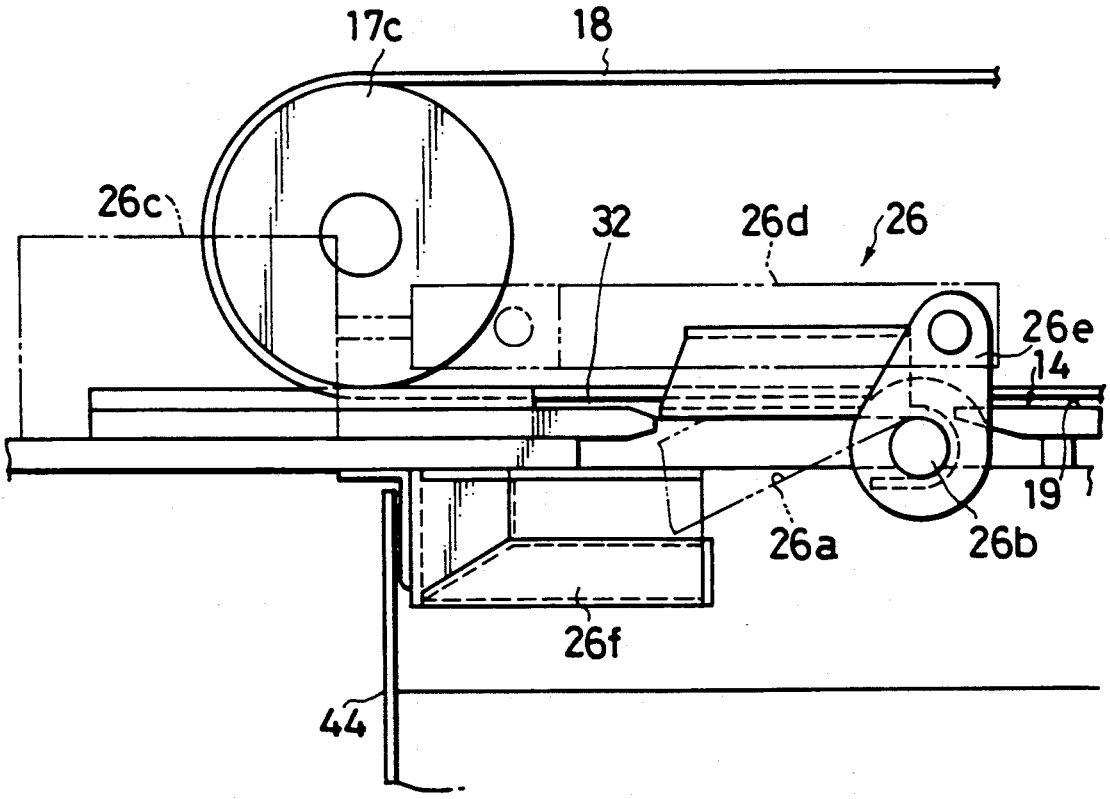
FIG. 5 is a schematic drawing showing a side view of a gate and a gate opening and closing mechanism for opening or closing the gate.
Figure 6:
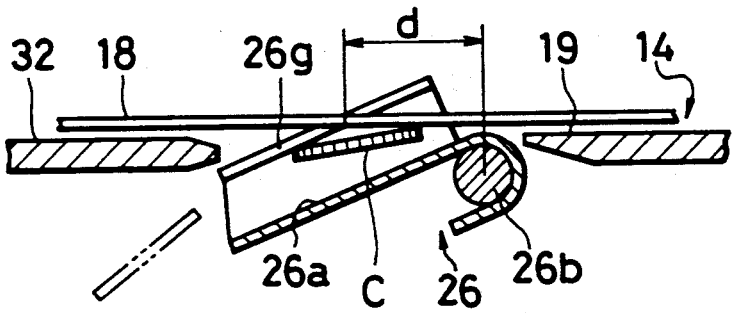
FIG. 6 is a schematic drawing showing a longitudinal cross-sectional view wherein a gate is opened.

FIG. 5 is a schematic drawing showing a side view of the gate 26 and a gate opening and closing mechanism for opening or closing the gate 26 and FIG. 6 is a schematic drawing showing a longitudinal cross-sectional view of the gate 26 and the gate opening and closing mechanism for opening or closing the gate 26 wherein the gate 26 is opened.

Referring to FIGS. 3, 5 and 6, the gate 26 is provided with a chute 26*a* and supported at one end thereof by a shaft 26*b* rotatably mounted on an lower portion of the coin discriminating and counting passage 14. A plunger of a gate opening and closing solenoid 26*c* is connected with a gate swing lever 26*e* via link 26*d* by a pin and the gate swing lever 26*e* is connected with the shaft 26*b*. A chute 26*f* communicating with a coin collecting compartment 44 described in detail later is provided off to the lower left of the chute 26*a*. The gate 26 has a quadrangular cylinder shape and an opening 26*g* is formed along the second transporting endless belt 18 for preventing the gate 26 from interferring with the second transporting endless belt 18. The gate 26 is normally closed and the upper face of thereof is positioned in the same plane as the upper face of the coin discriminating and counting passage 14 and the upper face of the coin separation passage 32, in order to ensure that the coins can smoothly pass over the gate 26. On the other hand, in the case where the coins are collected into the coin collecting compartment 44, the gate opening and closing solenoid 26*c* is driven to draw the gate swing lever 26*e* via the link 26*d* to the left in FIG. 5 and, as a result, as shown in FIG. 6, the gate is swung about the shaft 26*b* so that the chute 26*a* is inclined downwardly, whereby the coins C are led downwardly on the chute 26*a* and collected in the coin collecting compartment 44 via the chute 26*f*.

As described above, the operation for collecting coins C into the coin collecting compartment 44, that is, the operation for opening and closing the gate 26 is controlled by the control unit (not shown) in the control mechanism 9 based upon the signals input from the discriminating and counting sensor 23, the first sensor 24 and the second sensor 25. More specifically, when a coin passes through the discriminating and counting sensor 23, the control unit judges whether or not the dispensation cylinder 41*a*, 41*b*, 41*c*, 41*d*, 41*e* or 41*f* for storing coins having the denomination of the coin concerned is full based upon the detection signal input from the discriminating and counting sensor 23. As a result, in the case where the control unit judges that the dispensation cylinder 41*a*, 41*b*, 41*c*, 41*d*, 41*e* or 41*f* for storing coins having the denomination of the coin concerned is full, it outputs a gate open signal to the gate opening and closing solenoid 26c when the second sensor 25 detects the coin. The gate opening and closing solenoid 26c pulls the gate swing lever 26e to open the gate 26 and the coin is collected into the coin collecting compartment 44.

On the other hand, if the second sensor 25 detect a coin judged for collection in the coin collecting compartment 44, the following coin has been already detected by the first sensor 24, or if after the coin to be collected was detected by the first sensor 24, the preceding coin is detected by the second sensor 25, the operation for opening or closing the gate 26 is controlled in such a manner that the following coin or the preceding coin is collected via the gate 26 into the coin collecting compartment 44 together with the coin to be collected. Therefore, in the case where, based upon the signal input from the discriminating and counting sensor 23, the control unit judges that the coin to be collected is detected by the discriminating and counting sensor 23, when it judges in accordance with the detection signals from the first and second sensor 24, 25 that after the first sensor 24 detected the coin to be collected, the second sensor 25 detects the preceding coin, the control unit outputs the gate open signal to the gate opening and closing solenoid 26c to open the gate 26 at the time when the second sensor 25 detects the preceding coin, whereby the preceding coin is collected in the coin collecting compartment 44 together with the coin to be collected. Further, in the case where the first sensor 24 has already detected the following coin when the second sensor 25 detects the coin to be collected, the control unit outputs the gate open signal to the gate opening and closing solenoid 26c to open the gate 26 at the time when the second sensor 25 detects the coin to be collected, whereby the following coin is collected in the coin collecting compartment 44 together with the coin to be collected.

Further, as shown in FIG. 6, the gate 26 is designed in such a manner that when the gate is opened, the distance d measured along a line parallel to the discriminating and counting passage 14 between a crossing portion where the gate 26 crosses the second transporting endless belt 18 and a portion where the gate 26 begins to incline downwardly in the longitudinal cross-sectional view is greater than the greatest diameter of coins to be handled, for enabling all of the received coins C to be collected.

As shown in FIG. 1, the coins collected in the coin collecting compartment 44 are received in a coin collecting basket 46 mounted on a rotatable shaft 45 and rotatable together with the rotatable shaft 45 to the right or the left in FIG. 1 in accordance with the coin acceptance instruction or the cancel instruction. In the case where the operator inputs the cancel instruction to the coin receiving and dispensing machine 1, the rotatable shaft 45 is rotated counterclockwise and the coin collecting basket 46 is turned to the left in FIG. 1, whereby the coins received in the coin collecting basket 46 are fed to the coin dispensing compartment 43 via a collected coin return chute 47 to be returned to the operator. On the other hand, in the case where the coin acceptance instruction is input, the rotatable shaft 45 is rotated clockwise and the coin collecting basket 46 is turned to the right in FIG. 1, whereby the coins received in the coin collecting basket 46 are fed to a safe 48 detachable from the coin receiving and dispensing machine 1.

Figure 7:
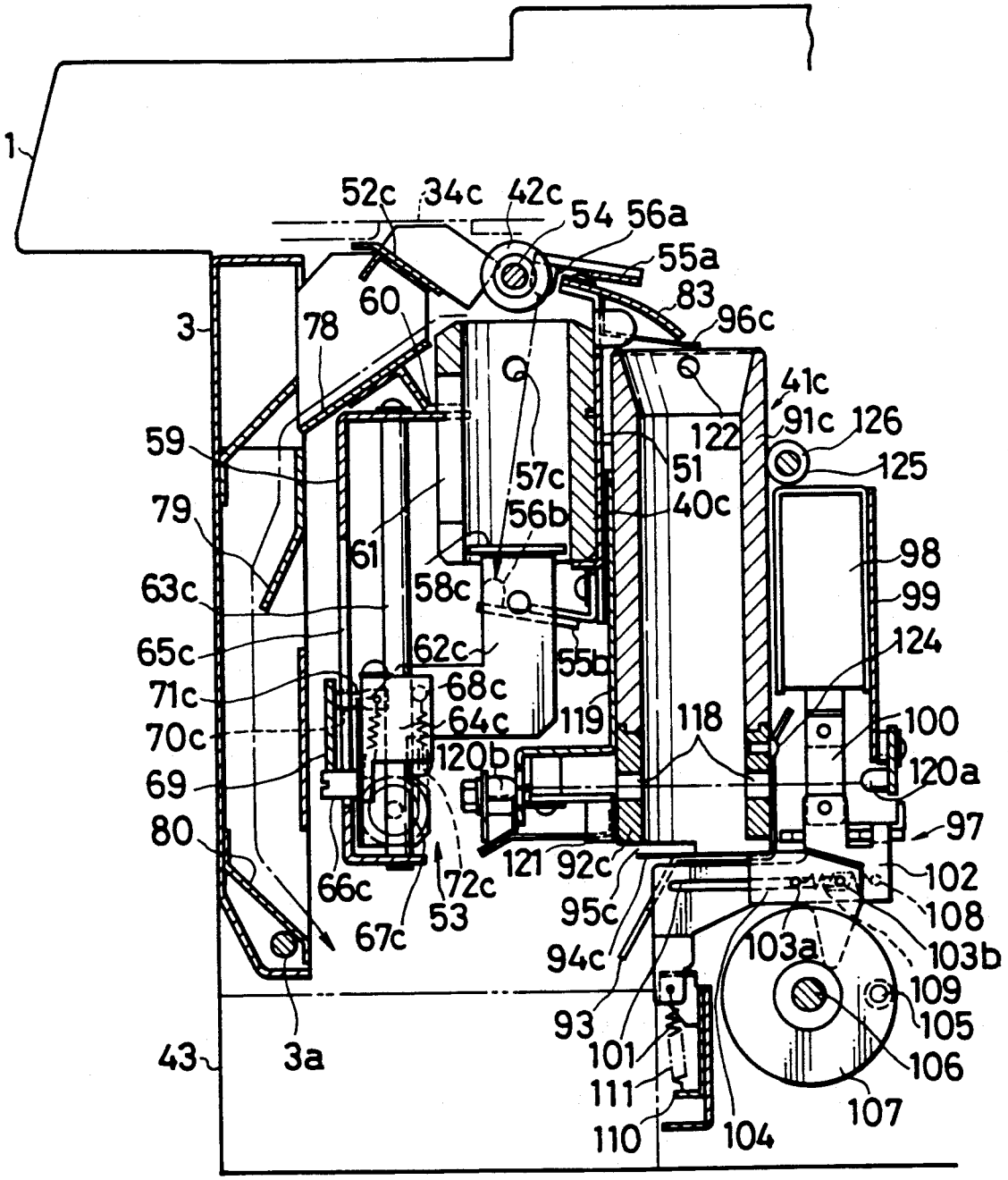
FIG. 7 is a schematic drawing showing a cross-sectional view taken on line V—V of FIG. 1.
Figure 8:
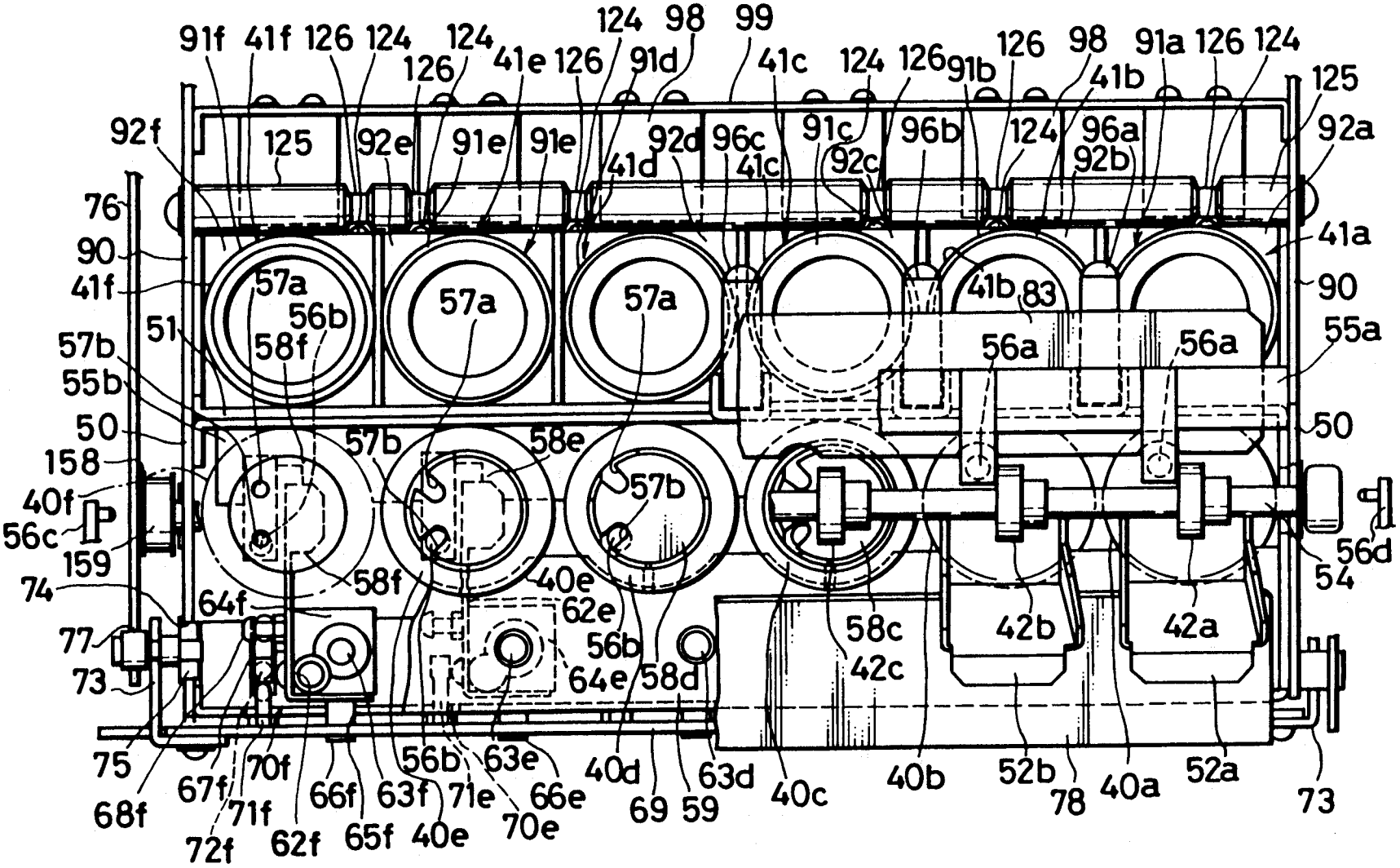
FIG. 8 is a schematic drawing showing a cross-sectional view taken on line W—W of FIG. 1 wherein a part thereof is cut away.
Figure 9:
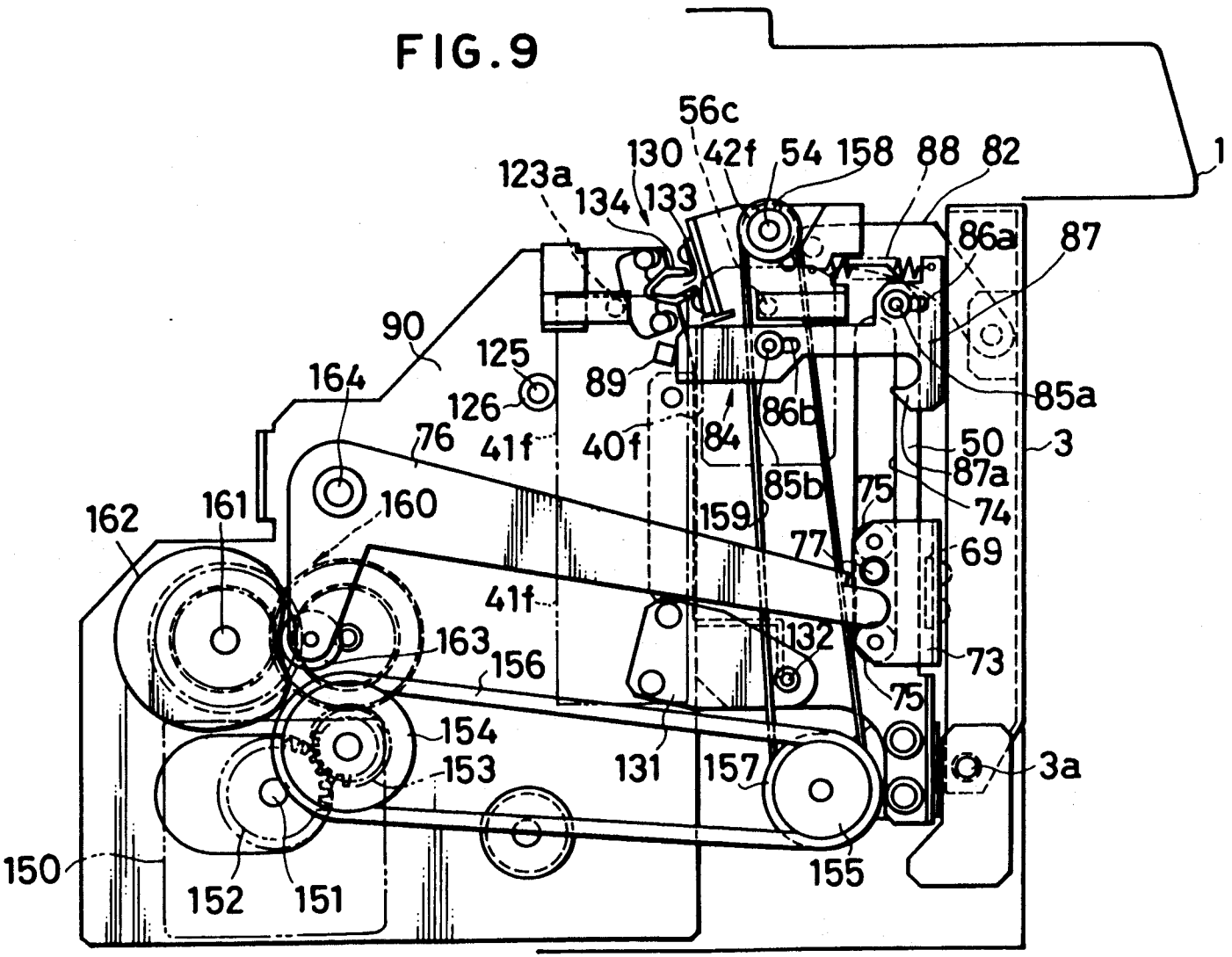
FIG. 9 is a schematic drawing showing a cross-sectional view taken on line X—X of FIG. 1.
Figure 10:
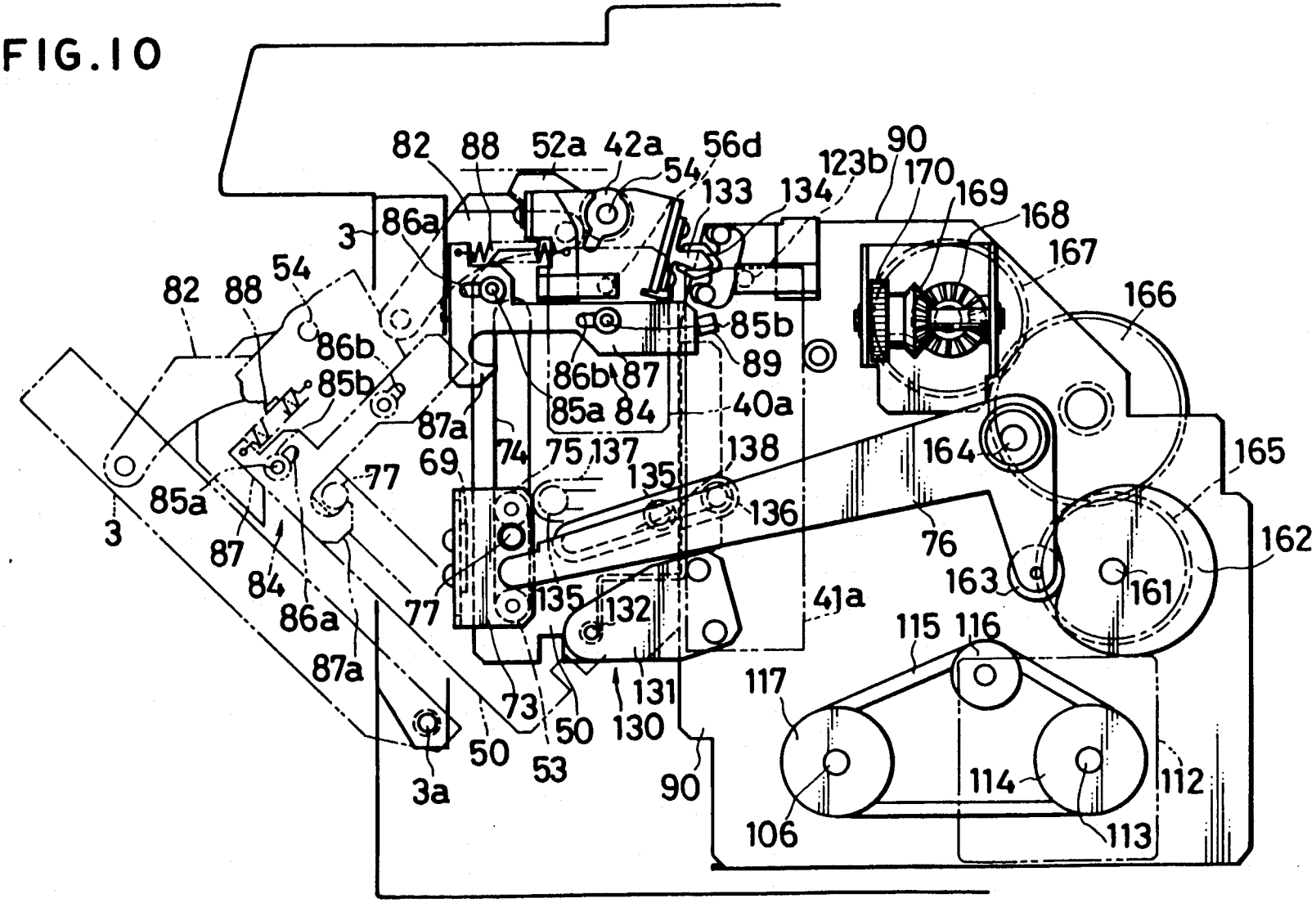
FIG. 10 is a schematic drawing showing a cross-sectional view taken on line Y—Y of FIG. 1.
Figure 11:
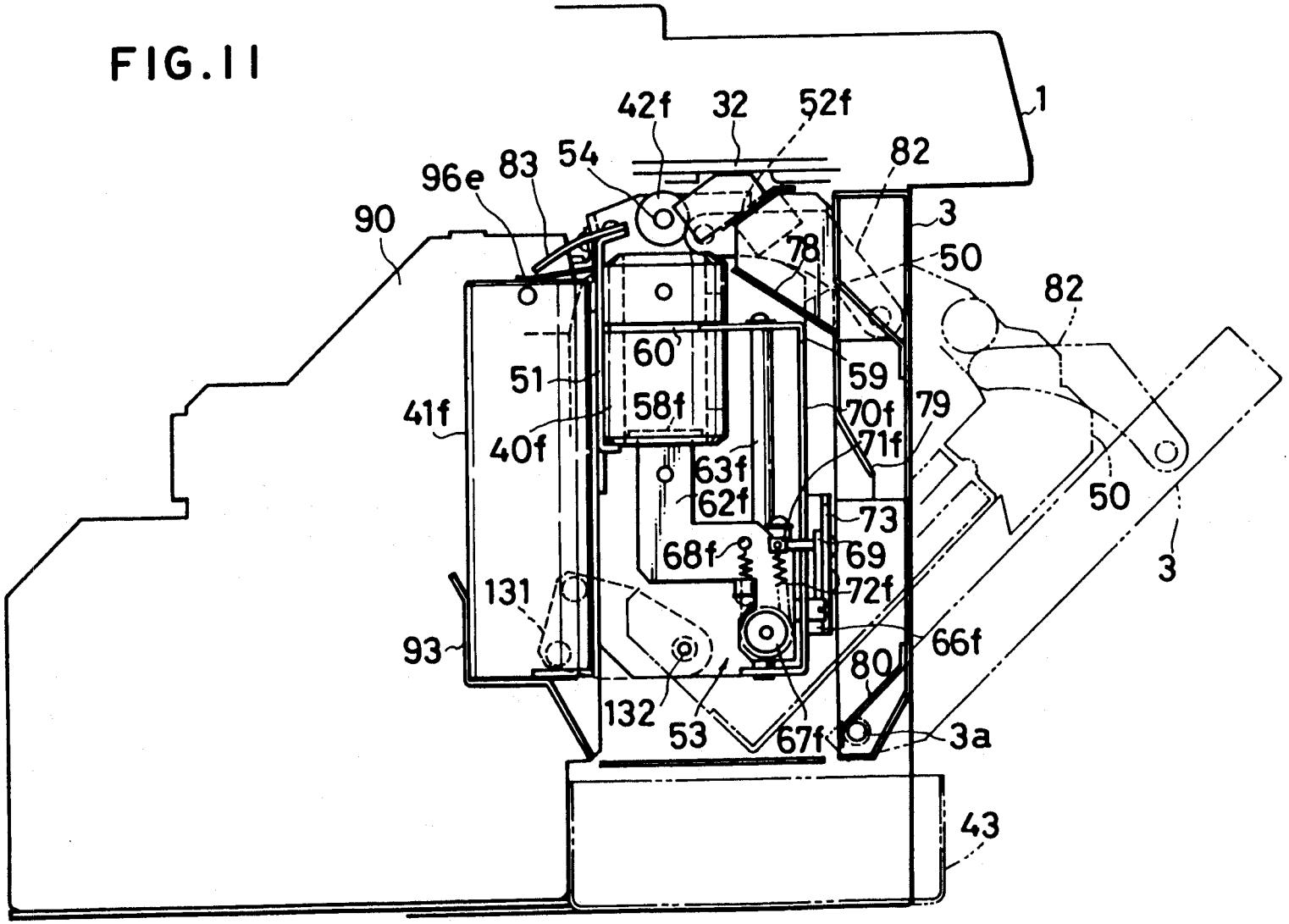
FIG. 11 is a schematic drawing showing a left perspective view of FIG. 1.
Figure 12:
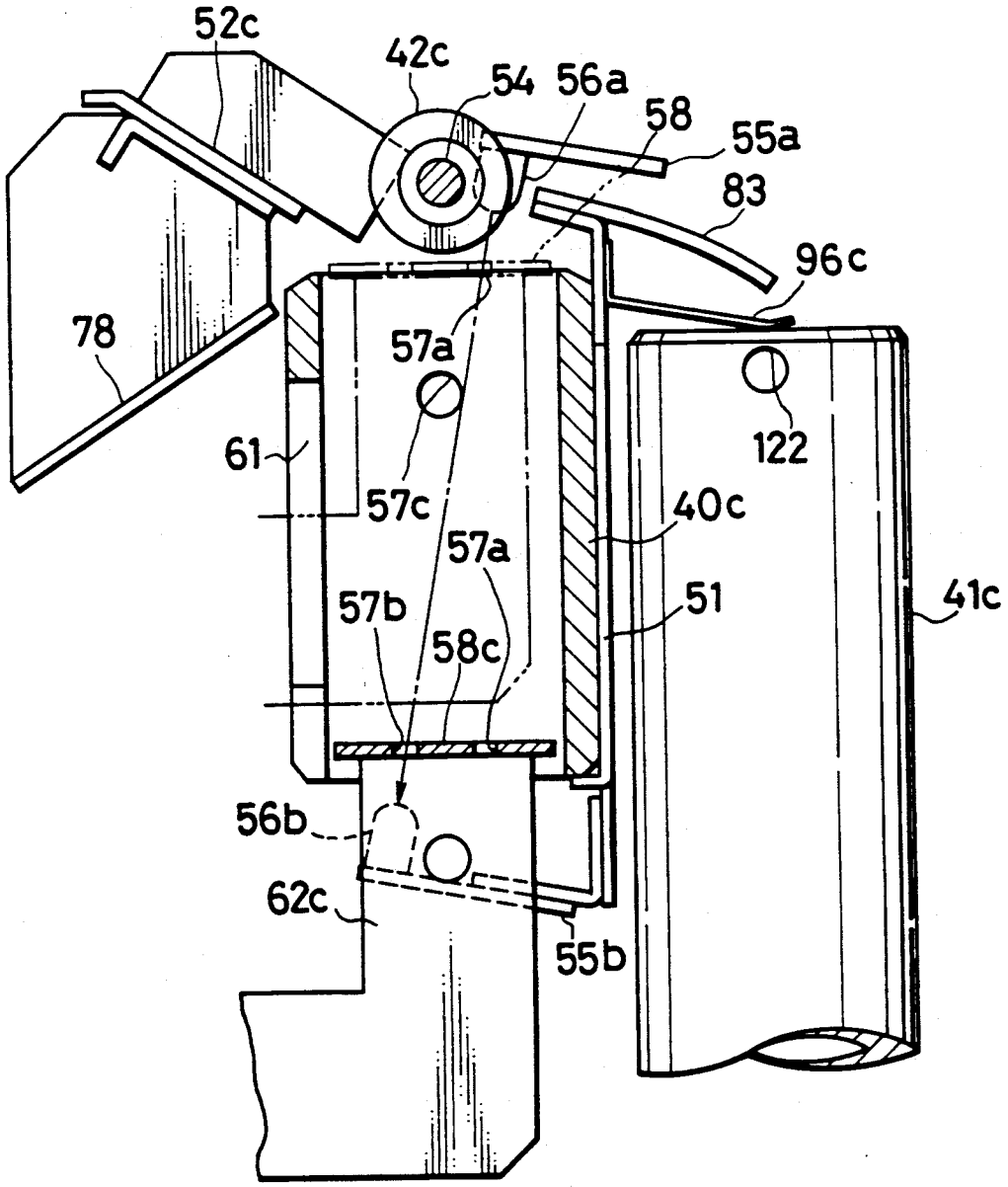
FIG. 12 is a schematic drawing showing an enlarged cross-sectional view of a portion of a temporary storing cylinder in FIG. 7.

FIG. 7 is a schematic drawing showing a cross-sectional view taken on line V—V of FIG. 1 and showing details of the front mechanism 6 and the rear mechanism 7. FIG. 8 is a schematic drawing showing a cross-sectional view take on line W—W of FIG. 1, FIG. 9 is a schematic drawing showing a cross-sectional view taken on line X—X of FIG. 1, FIG. 10 is a schematic drawing showing a cross-sectional view taken on line Y—Y of FIG. 1, FIG. 11 is a schematic drawing showing a left perspective view of FIG. 1, and FIGS. 8 to 11 show details of the front mechanism 6, the rear mechanism 7 and the drive mechanism. FIG. 12 is a schematic drawing showing an enlarged cross-sectional view of a part of FIG. 1.

Referring to FIGS. 7 to 11, a first frame 51 is secured at opposite ends thereof to a pair of front side plates 50 for covering the front mechanism 6, and below the coin sorting openings 34a, 34b, 34c, 34d, 34e, 34f, there is provided sorting chutes 52a, 52b, 52c, 52d, 52e, 52f for feeding the received coins into the temporary storing cylinders 40a, 40b, 40c, 40d, 40e, 40f each being for storing received coins having a different denomination. In FIG. 7, only the coin sorting opening 34c and the sorting chute 52c are shown, in FIG. 12, only the sorting chute 52c is shown and in FIGS. 7 and 8, only the sorting chutes 52a, 52b are shown for convenience of explanation.

The temporary storing cylinders 40a, 40b, 40c, 40d, 40e, 40f are secured to the first frame 51. Further, there is provided a coin supporting mechanism 53 for supporting the coins stored in the temporary storing cylinders 40a, 40b, 40c, 40d, 40e, 40f and lifting the coins for feeding them to the dispensation cylinders 41a, 41b, 41c, 41d, 41e, 41f or the coin dispensing compartment 43 when the coin acceptance instruction or the cancel instruction is input to the coin receiving and dispensing machine 1. In the vicinity of upper openings of the temporary storing cylinders 40a, 40b, 40c, 40d, 40e, 40f, there are provided take-out rollers 42a, 42b, 42c, 42d, 42e, 42f each secured to a rotatable shaft 54 rotatable by the control mechanism 9 which is rotatably mounted on the pair of the front side plates 50. The take-out rollers 42a, 42b, 42c, 42d, 42e, 42f are driven by the control mechanism 9 so as to selectively feed the coins stored in the temporary storing cylinders 40a, 40b, 40c, 40d, 40e, 40f and lifted by the coin supporting mechanism 53 to the dispensation cylinders 41a, 41b, 41c, 41d, 41e, 41f or the coin dispensing compartment 43 in accordance with the coin acceptance instruction or the cancel instruction. In FIG. 7, only the take-out roller 42c is shown; in FIG. 9, only the take-out roller 42f is shown; in FIG. 10, only the take-out roller 42a is shown; and in FIG. 8, the take-out rollers 42a, 42b, 42c are shown for convenience of explanation.

As shown in FIGS. 7 and 12, a pair of photo sensors 56a, 56b are respectively secured to a mounting plate 55a secured to the front side plates 50 at the opposite ends thereof above the first frame 51 and a mounting plate 55b secured to the front side plates 50 at the opposite ends thereof below the first frame 51, and a pair of transmission openings 57a, 57b are formed on each support plate 58a, 58b, 58c, 58d, 58e, 58f constituting the bottom portion of the temporary storing cylinder 40a, 40b, 40c, 40d, 40e, 40f for supporting the received coins on the upper faces thereof. The positions of the pair of photo sensors 56a, 56b and the pair of the transmission openings 57a, 57b are determined so that when each of the support plates 58a, 58b, 58c, 58d, 58e, 58f is moved to its uppermost position by the coin supporting mechanism 53 for feeding out the received coins stored in the temporary storing cylinder 40*a*, 40*b*, 40*c*, 40*d*, 40*e*, 40*f*, light emitted from one of the photo sensors 56*a*, 56*b* is detected by the other through the transmission opening 57*a* and that, on the other hand, when each of the support plates 58*a*, 58*b*, 58*c*, 58*d*, 58*e*, 58*f* is moved to its lowermost position for receiving the received coins from one of the sorting chutes 52*a*, 52*b*, 52*c*, 52*d*, 52*e*, 52*f*, light emitted from one of the photo sensors 56*a*, 56*b* is detected by the other through the transmission opening 57*b*. Therefore, it is possible to judge whether each of the support plates 58*a*, 58*b*, 58*c*, 58*d*, 58*e*, 58*f* is positioned at its uppermost position or its lowermost position, in other words, whether the feed-out operation has been completed and no coin is present in the temporary storing cylinders 40*a*, 40*b*, 40*c*, 40*d*, 40*e*, 40*f*, or the temporary storing cylinders 40*a*, 40*b*, 40*c*, 40*d*, 40*e*, 40*f* are ready for receiving coins from the sorting chutes 52*a*, 52*b*, 52*c*, 52*d*, 52*e*, 52*f*. As shown in FIG. 8, the transmission openings 57*a*, 57*b* provided for the support plates 58*a*, 58*b*, 58*c*, 58*d*, 58*e* are formed as notches, while the transmission openings 57*a*, 57*b* provided for the support plates 58*f* are formed as circular openings. This is because it is possible to determine the positions of the pair of the photo sensors 56*a*, 56*b* and the transmission openings 57*a*, 57*b* in the above described manner without forming the transmission openings 57*a*, 57*b* as notches since the temporarily storing cylinder 40*f* is for storing the coins having the greatest diameter.

Further, as shown in FIGS. 7 and 12, the upper portion of each temporary storing cylinder 40*a*, 40*b*, 40*c*, 40*d*, 40*e*, 40*f* is formed with a pair of transmission openings 57*c* at the opposite positions in the lateral direction of the coin receiving and dispensing machine 1 and, as shown in FIG. 8, a pair of photo sensors 56*c*, 56*d* are secured to the outsides of the pair of front side plates 50 at positions corresponding to those of the pair of the transmission openings 57*c*, one emitting light and the other receiving light. Each of the pair of transmission openings 57*c* are formed at positions above an upper face of the uppermost coin when the maximum number of coins are stored in the temporary storing cylinder 40*a*, 40*b*, 40*c*, 40*d*, 40*e*, 40*f* and, therefore, if the coins are stored while being stacked, light emitted from one of the pair of photo sensors 56*c*, 56*d* is received by the other, but if one or more coins stand erect in at least one of the temporary storing cylinder 40*a*, 40*b* 40*c*, 40*d*, 40*e*, 40*f* when the coins are fed into the temporary storing cylinders, since light emitted from one of the pair of photo sensors 56*c*, 56*d* is interrupted by the coins, it is possible to detect that the coins are not properly stacked in at least one of the temporary storing cylinder 40*a*, 40*b*, 40*c*, 40*d*, 40*e*, 40*f*.

On the front side of the temporary storing cylinder 40*a*, 40*b*, 40*c*, 40*d*, 40*e*, 40*f*, there is provided a second frame 59 secured to the pair of front side plates 50 at the opposite ends thereof and engaged with annular grooves 60 formed on the outer face of the temporary storing cylinder 40*a*, 40*b*, 40*c*, 40*d*, 40*e*, 40*f*. For convenience of explanation, only the annular grooves 60 formed on the outer faces the temporary storing cylinders 40*c*, 40*f* are shown in FIGS. 7 and 11 and the others are omitted.

The aforementioned coin supporting mechanism 53 comprises the support plates 58*a*, 58*b*, 58*c*, 58*d*, 58*e*, 58*f* elevatable in the temporary storing cylinders 40*a*, 40*b*, 40*c*, 40*d*, 40*e*, 40*f* for supporting the coins on the upper face thereof and support arms 62*a*, 62*b*, 62*c*, 62*d*, 62*e*, 62*f*, each secured to one of the support plates 58*a*, 58*b*, 58*c*, 58*d*, 58*e*, 58*f* and movable in the vertical direction along one of slits 61 (for convenience of explanation, only the slit 61 formed on the outer face of the temporary storing cylinder 40*c* is shown in FIG. 7). As shown in FIG. 7, each of the support arms 62*a*, 62*b*, 62*c*, 62*d*, 62*e*, 62*f* consists of a first vertical portion extending in the vertical direction, a horizontal portion extending horizontally from the lower end of the first vertical portion and a second vertical portion extending vertically from the end of the horizontal portion.

The coin supporting mechanism further includes fixed shafts 63*a*, 63*b*, 63*c*, 63*d*, 63*e*, 63*f*, and elevatable blocks 64*a*, 64*b*, 64*c*, 64*d*, 64*e*, 64*f* engaged with the fixed shafts 63*a*, 63*b*, 63*c*, 63*d*, 63*e*, 63*f* and secured to the lower portion of the horizontal portion of the support arms 62*a*, 62*b*, 62*c*, 62*d*, 62*e*, 62*f*. The second frame 59 is formed with slits 65*a*, 65*b*, 65*c*, 65*d*, 65*e*, 65*f* for the temporary storing cylinder 40*a*, 40*b*, 40*c*, 40*d*, 40*e*, 40*f* (for convenience of explanation, only the slit 65*c* is shown in FIG. 7 and only the slit 65*f* is shown in FIG. 8, and the others are omitted) and blocks 66*a*, 66*b*, 66*c*, 66*d*, 66*e*, 66*f* are secured to the front faces of the horizontal portions of the support arms 62*a*, 62*b*, 62*c*, 62*d*, 62*e*, 62*f*, each being elevatable along one of the slits 65*a*, 65*b*, 65*c*, 65*d*, 65*e*, 65*f* (for convenience of explanation, only the block 66*c* is shown in FIG. 7 and only the blocks 66*e*, 66*f* are shown in FIG. 8, and the others are omitted). Further, there are provided at the lower portion of the second vertical portions of the support arms 62*a*, 62*b*, 62*c*, 62*d*, 62*e*, 62*f* rotatable pulleys 67*a*, 67*b*, 67*c*, 67*d*, 67*e*, 67*f* and pins 68*a*, 68*b*, 68*c*, 68*d*, 68*e*, 68*f* above these rotatable pulleys (for convenience of explanation, only the pulley 67*c* and the pin 68*c* are shown in FIG. 7 and only the pulley 67*f* and the pin 68*f* are shown in FIG. 8, and the others are omitted).

Moreover, there is a provided an elevatable plate 69 supported by the elevatable blocks 66*a*, 66*b*, 66*c*, 66*d*, 66*e*, 66*f* at the lower end thereof and pins 71*a*, 71*b*, 71*c*, 71*d*, 71*e*, 71*f* are secured to the elevatable plate 69, each of pins 71*a*, 71*b*, 71*c*, 71*d*, 71*e*, 71*f* extending toward one of the support arms 62*a*, 62*b*, 62*c*, 62*d*, 62*e*, 62*f* via one of slits 70*a*, 70*b*, 70*c*, 70*d*, 70*e*, 70*f*. Coil springs 72*a*, 72*b*, 72*c*, 72*d*, 72*e*, 72*f* are fixed to the pins 68*a*, 68*b*, 68*c*, 68*d*, 68*e*, 68*f* and the pins 71*a*, 71*b*, 71*c*, 71*d*, 71*e*, 71*f* at the opposite ends thereof respectively and are engaged with the pulleys 67*a*, 67*b*, 67*c*, 67*d*, 67*e*, 67*f*. For convenience of explanation, only the slit 70*c*, the pin 71*c* and the coil spring 72*c* are shown in FIG. 7 and only the slit 70*e*, 70*f*, the pins 71*e*, 71*f* and the coil spring 72*f* are shown in FIG. 8, and the others are omitted.

A pair of L-shaped roller mounting plates 73, 73 are secured to the opposite ends of the elevatable plate 69 an a pair of guide rollers 75, 75 are provided inside of the roller mounting plate 73, 73, each guide roller 75 being rotatable and movable in the vertical direction along one of slits 74, 74 formed on the front side plate 50 and extending vertically. Further, a pair of elevatable shafts 77, 77 are provided outside of the roller mounting plates 73, 73, each elevatable shaft 77 being engageable with one of a pair of swing levers 76, 76 of the drive mechanism described later. In FIG. 8, only one of the swing levers 76, 76 and one of the elevatable shafts 77, 77 are shown, and the others are omitted. As described later, the elevatable shafts 77, 77 can be lifted by the swing levers 76, 76, thereby to enable the support plates 58*a*, 58*b*, 58*c*, 58*d*, 58*e*, 58*f* of the temporary storing cylinders 40*a*, 40*b*, 40*c*, 40*d*, 40*e*, 40*f* to be lifted to the uppermost position.

A first return chute 78 is mounted on an upper portion of the second frame 59, a second return chute 79 is mounted on the front door 3 below the first return chute 78 and a third return chute 80 is mounted on the front door 3 below the second chute 79. In the case where the operator inputs the cancel instruction to the coin receiving and dispensing machine 1 after the coins have been stored in the temporary storing cylinders 40*a*, 40*b*, 40*c*, 40*d*, 40*e*, 40*f*, the support plates 58*a*, 58*b*, 58*c*, 58*d*, 58*e*, 58*f* are lifted to their uppermost position by the coin supporting mechanism 53 and take-out rollers 42*a*, 42*b*, 42*c*, 42*d*, 42*e*, 42*f* are rotated, whereby the received coins are fed to the first return chute 78 from the temporary storing cylinders 40*a*, 40*b*, 40*c*, 40*d*, 40*e*, 40*f* and returned to the coin dispensing compartment 43 via the second return chute 79 and the third return chute 80. As described above, the front door 3 is mounted on the pivot shaft 3*a* fixed to the casing 2 of the coin receiving and dispensing machine 1 so as to be forwardly pivotable about the pivot shaft 3*a* and the front mechanism 6 can be exposed to the outside by pivoting the front door 3 forwardly about the pivot shaft 3*a*. Further, a pair of connecting plates 82, 82 are connected by pins to the front door 3 and the pair of front side plates 50 at the opposite ends thereof respectively, thereby to connect the front door 3 and the pair of front side plates 50. Accordingly, when the front door 3 is forwardly pivoted about the pivot shaft 3*a*, the pair of the front side plates 50 and various means mounted on them are drawn forwardly together with the front door 3.

A guide plate 83 is provided above the temporary storing cylinders 40*a*, 40*b*, 40*c*, 40*d*, 40*e*, 40*f* for guiding the coins to the dispensation cylinders 41*a*, 41*b*, 41*c*, 41*d*, 41*e*, 41*f*.

Referring to the FIGS. 9 and 10, engaging mechanisms are provided for engaging the elevatable shafts 77, 77 in the case where the front door 3 is opened and the supports plates 58*a*, 58*b*, 58*c*, 58*d*, 58*e*, 58*f* are manually lifted together with the elevatable shaft, and the coins stored in the temporary storing cylinders 40*a*, 40*b*, 40*c*, 40*d*, 40*e*, 40*f* are removed, because the coins have jammed in one of the temporarily storing cylinders 40*a*, 40*b*, 40*c*, 40*d*, 40*e*, 40*f*. The engaging mechanisms 84 are provided for the pair of the front side plates 50 respectively and each of them comprises two slots 86*a*, 86*b*, each extending horizontally and engaged with one of guide shafts 85*a*, 85*b* formed on each of the front side plates 50, a lock plate 87 formed with a hook 87*a* at the lower end portion thereof, a tension spring 88 fixed to an upper portion of the lock plate 87 and the front side plate 50 for biasing the hook 87*a* toward the slit 74 for guiding the guide roller 75, and a lock member 89 fixed to one of rear side plates 90 disposed on the rear sides of the front side plates 50 and described later for locking the lock plate 87 so that the hook 87*a* retracts forwardly from the slit 74 against the tensile force of the tension spring 88 when the front door 3 is closed.

In the thus constituted engaging mechanism 84, in the case where the front door 3 is opened for removing the coins stored in the temporary storing cylinders 40*a*, 40*b*, 40*c*, 40*d*, 40*e*, 40*f*, because the coins have jammed in one of the temporary storing cylinders 40*a*, 40*b*, 40*c*, 40*d*, 40*e*, 40*f*, since the lock members 89 are fixed to the pair of the rear side plates 90, when the front door 3 is opened, the lock plates 87 are pulled toward the slits 74 by the tensile force of the tension springs 88 and project in the slits 74. Accordingly, when the support plates 58*a*, 58*b*, 58*c*, 58*d*, 58*e*, 58*f* are manually lifted for removing the coins from the temporary storing cylinders 40*a*, 40*b*, 40*c*, 40*d*, 40*e*, 40*f*, the elevatable shafts 77, 77 are engaged with the hooks 87*a* and held by them, whereby the coins can be easily removed from the temporary storing cylinders 40*a*, 40*b*, 40*c*, 40*d*, 40*e*, 40*f*.

The rear mechanism 7 is provided with the dispensation cylinders 41*a*, 41*b*, 41*c*, 41*d*, 41*e*, 41*f* between the pair of the rear side plates 90 disposed on the rear sides of the pair of the front side plates 50. Each of the dispensation cylinders 41*a*, 41*b*, 41*c*, 41*d*, 41*e*, 41*f* comprises a cylindrical portion 91*a*, 91*b*, 91*c*, 91*d*, 91*e*, 91*f* having a circular hollow cross section and a quadrangular cylindrical portion 92*a*, 92*b*, 92*c*, 92*d*, 92*e*, 92*f* having a circular hollow cross section having the same diameter as that of the cylindrical portion 91*a*, 91*b*, 91*c*, 91*d*, 91*e*, 91*f* and is formed integrally by engaging the former with the latter. A bottom plate 94*a*, 94*b*, 94*c*, 94*d*, 94*e*, 94*f* is fixed to each of the quadrangular cylindrical portion 92*a*, 92*b*, 92*c*, 92*d*, 92*e*, 92*f* and a coin dispensing opening 95*a*, 95*b*, 95*c*, 95*d*, 95*e*, 95*f* having a predetermined space is formed between the lower end of each of the quadrangular cylindrical portion 92*a*, 92*b*, 92*c*, 92*d*, 92*e*, 92*f* and the corresponding bottom plate 94*a*, 94*b*, 94*c*, 94*d*, 94*e*, 94*f*. Each of the dispensation cylinders 41*a*, 41*b*, 41*c*, 41*d*, 41*e*, 41*f* is fixed to the coin receiving and dispensing machine 1 at a predetermined position by a dispensation cylinder position regulating plate 93 fixed to the coin receiving and dispensing machine 1. Each of the circular hollow portion formed in the cylindrical portions 91*a*, 91*b*, 91*c*, 91*d*, 9le, 91*f* and the quadrangular cylindrical portion 92*a*, 92*b*, 92*c*, 92*d*, 92*e*, 92*f* has a diameter sufficient for receiving a predetermined denomination of coins therein. Each of the bottom plates 94*a*, 94*b*, 94*c*, 94*d*, 94*e*, 94*f* is formed with an opening (not shown) extending in the lateral direction in FIG. 7 from the right end to the left end thereof for dispensing the coins from the dispensation cylinders 41*a*, 41*b*, 41*c*, 41*d*, 41*e*, 41*f*.

Further, each of the dispensation cylinders 41*a*, 41*b*, 41*c*, 41*d*, 41*e*, 41*f* is detachably mounted on the coin receiving and dispensing machine 1 and is biased downwardly by a plate-like spring 96*a*, 96*b*, 96*c*, 96*d*, 96*e*. Each of the plate-like spring 96*a*, 96*b*, 96*c*, 96*d*, 96*e* presses two dispensation cylinders 41*a*, 41*b*, 41*c*, 41*d*, 41*e*, 41*f* adjacent to each other. In FIG. 7, only the dispensation cylinder 41*c*, the cylindrical portion 91*c*, the quadrangular cylindrical portion 92*c*, the bottom plate 94*c*, the coin dispensing opening 95*c* and the plate-like spring 96*c* are shown; in FIG. 9, only the dispensation cylinder 41*f* is shown; in FIG. 10, only the dispensation cylinder 41*a* is shown; in FIG. 11, only the dispensation cylinder 41*f* is shown; in FIG. 12, the dispensation cylinder 41*c* and the plate-like spring 96*c* are shown; and in FIG. 8, the plate-like springs 96*a*, 96*b* and 96*c* are shown for convenience of explanation.

As shown in FIG. 7, a dispensing apparatus 97 for dispensing coins is provided for each of the quadrangular cylindrical portion 92*a*, 92*b*, 92*c*, 92*d*, 92*e*, 92*f* of the dispensation cylinders 41*a*, 41*b*, 41*c*, 41*d*, 41*e*, 41*f*. The dispensing apparatus 97 has the same structure in all of the dispensation cylinders 41*a*, 41*b*, 41*c*, 41*d*, 41*e*, 41*f*. The dispensing apparatus 97 comprises a mounting plate 99 for fixing a solenoid 98, a link 100 connected with a plunger of the solenoid 98 by a pin, a coin push plate holding member 102 connected with the link by a pin and formed with a slot 101, a coin push plate 104 having two pins 103*a*, 103*b* engaged with the slot 101 and supported by the coin push plate holding member 102 so as to be horizontally movable, the coin push plate 104 being positioned below the bottom plate 94*a*, 94*b*, 94*c*, 94*d*, 94*e*, 94*f* and lifted through the opening not shown) of the bottom plates 94*a*, 94*b*, 94*c*, 94*d*, 94*e*, 94*f* when the solenoid 98 is turned on so that the upper edge thereof is positioned above the bottom plates 94*a*, 94*b*, 94*c*, 94*d*, 94*e*, 94*f* by a distance not greater than the thickness of a coin, a cam 107 having a projection 105 engageable with the lower end of the coin push plate 104 and mounted on a rotatable shaft 106, a first tension spring 109 fixed to the pin 103*a* formed on the coin push plate 104 and disposed on the front side and a pin formed on the coin push plate holding member 102 at the opposite ends thereof for biasing the coin push plate 104 rearwardly, that is, toward the right in FIG. 7, and a second tension spring 111 fixed to the coin push plate holding member 102 and a spring fixing member 110 for biasing the coin push plate holding member 102 downwardly. Further, each of the dispensation cylinders 41*a*, 41*b*, 41*c*, 41*d*, 41*e*, 41*f* is biased by the plate-like spring 96*a*, 96*b*, 96*c*, 96*d*, 96*e* toward the dispensation cylinder position regulating plate 93.

As shown in FIG. 10, in the thus constituted dispensing apparatus 97, the coin push plate 104 is pushed into each of the coin dispensing openings 95*a*, 95*b*, 95*c*, 95*d*, 95*e*, 95*f* along the opening (not shown) formed in the bottom plates 94*a*, 94*b*, 94*c*, 94*d*, 94*e*, 94*f* by transmitting the rotation of a drive pulley 114 fixed to a drive shaft 113 driven by a dispensing drive source 112 to a pulley 116 and a pulley 117 integrally formed with the rotatable shaft 106 via a belt 115 and rotating the cam 107 counterclockwise in FIG. 7, whereby the coins are dispensed one by one.

Further, each of the quadrangular cylindrical portions 92*a*, 92*b*, 92*c*, 92*d*, 92*e*, 92*f* are formed with a pair of transmission openings 118 in the vicinity of the bottom portion thereof and a pair of photo sensors 120*a*, 120*b* are mounted on the mounting plate 99 and a sensor mounting plate 119 on the opposite sides of the transmission openings 118 for detecting whether or not the number of coins stored in each of the dispensation cylinders 41*a*, 41*b*, 41*c*, 41*d*, 41*e*, 41*f* is not greater than a predetermined number. Moreover, a dispensed coin counting sensor 121 is mounted on the sensor mounting plate 119 for counting the number of the dispensed coins.

An upper portion of each of the cylindrical portions 91*a*, 91*b*, 91*c*, 91*d*, 91*e*, is formed with a pair of transmission openings 122 in the lateral direction of the coin receiving and dispensing machine 1 and, further, as shown in FIGS. 9 and 10, a pair of photo sensors 123*a*, 123*b* one being for emitting light and the other being receiving the emitted light, via the pair of the rear side plates 90 and the pair of the transmission openings 122 are provided outside of the pair of rear side plates 90. The pair of transmission openings 122 are formed at positions above an upper face of the uppermost coin when the maximum number of coins are stored while being stacked in each of the dispensation cylinder 41*a*, 41*b*, 41*c*, 41*d*, 41*e*, 41*f*, whereby it is possible to detect without fail whether or not the coins are stored while being stacked in the dispensation cylinders 41*a*, 41*b*, 41*c*, 41*d*, 41*e*, 41*f* when the coins are fed thereinto, in other words, whether or not there are coins standing erect.

Further, as shown in FIGS. 7 and 8, set pins 124 are secured to the quadrangular cylindrical portions 92*a*, 92*b*, 92*c*, 92*d*, 92*e*, 92*f* at a different positions with respect to the lateral direction of the coin receiving and dispensing machine 1 and a dispensation cylinder set shaft 125 extending laterally is mounted on the pair of rear side plates 90 at the opposite ends thereof. The dispensation cylinder set shaft 125 is formed with a plurality of grooves 126 at positions corresponding to the respective set pins 124 and the dispensation cylinder 41*a*, 41*b*, 41*c*, 41*d*, 41*e*, 41*f* can be mounted on the coin receiving and dispensing machine 1 only when the position of the set pin 124 agrees with that of the groove 126, whereby each of the dispensation cylinders 41*a*, 41*b*, 41*c*, 41*d*, 41*e*, 41*f* can be mounted on the coin receiving and dispensing machine 1 at a predetermined position without fail.

As shown in FIGS. 9 and 10, the front mechanism 6 and the rear mechanism 7 are detachably connected with each other by a pair of identical connecting mechanisms 130 which is provided on the opposite outer sides of the pair of the front side plates 50 and the pair of the rear side plates 90.

Each of the connecting mechanism 130 is provided with a bearing plate 131 fixed to one of the rear side plates 90 and a shaft 132 rotatably mounted on the bearing plate 131 for supporting one of the front side plates 50. Each of the front side plates 50 is formed with a diamond-shaped projection 133 and each of the rear side plates 90 is formed with an engaging member 134 made of a elastic plate and having an engaging portion engageable with the projection 133 for connecting the front side plate 50 and the rear side plate 90 by engaging with the projection 133. As shown in FIG. 10, although omitted in FIG. 9, an outer face of each of the front side plates 50 is provided with a shaft 135 and an outer face of the rear side plate 90 is provided with a shaft 136 and these shaft are engaged with a slot 138 formed in a stopper plate 137. Accordingly, in the case where the engagement between the projection 133 and the engaging member 134 is released, the front side plate 50 can be forwardly pivoted until the shaft 135 formed on the front side plate 50 reaches the end of the slot 138 formed in the stopper plate 137. The phantom lines in FIGS. 9 and 11 show the coin receiving and dispensing machine 1 with the front door 3 opened and the front side plates 50 forwardly pivoted.

Figure 13:
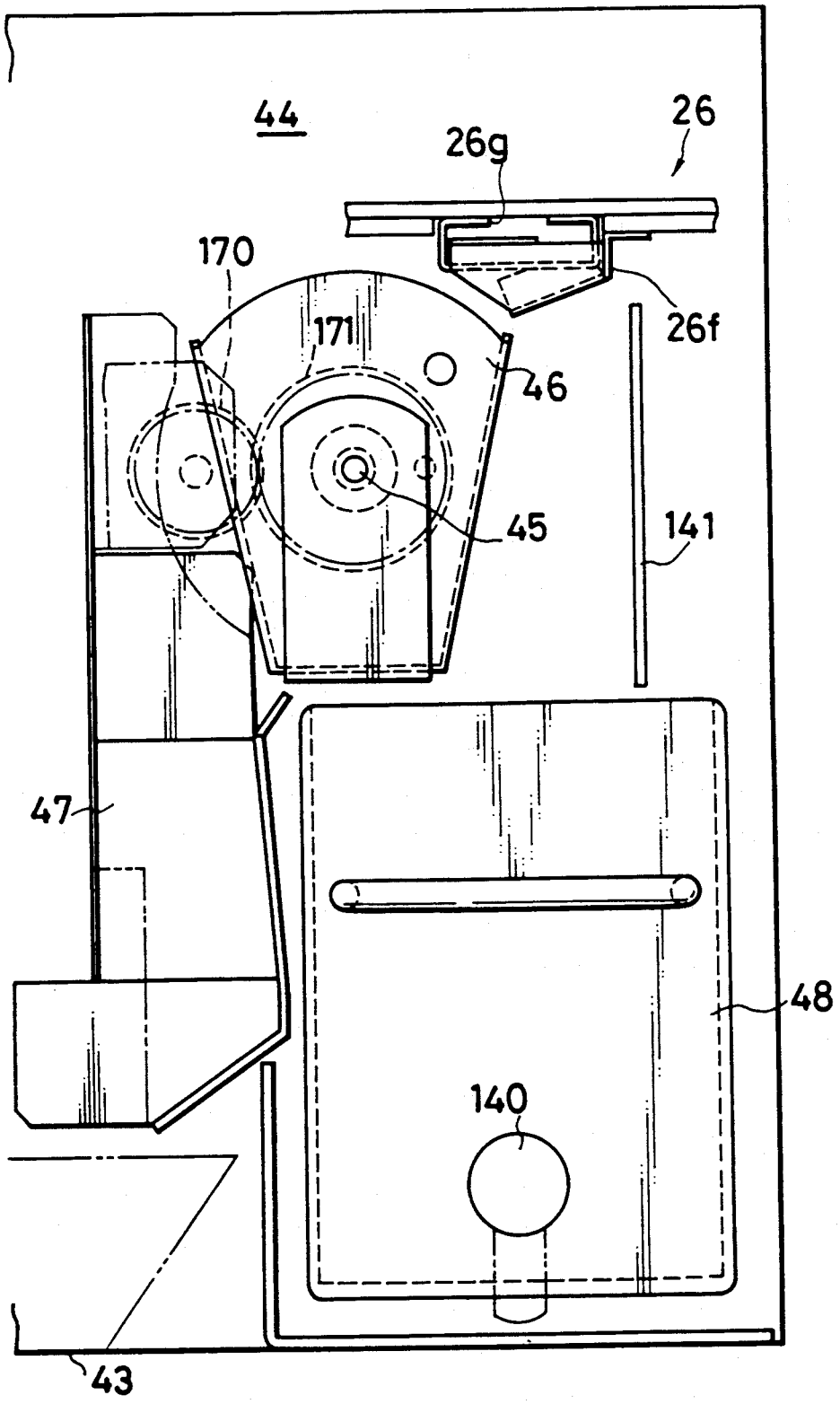
FIG. 13 is a schematic drawing showing a front view of a coin collecting compartment.

FIG. 13 shows structure of the coin collecting compartment 44 in detail. The coin collecting basket 46 supported by the rotatable shaft 45 is provided below the chute 26*f* of the gate 26, the coin return chute 47 is provided off to the lower left of the coin collecting basket 46, and the safe 48 detachable from the coin receiving and dispensing machine 1 is provided off to the lower right of the coin collecting basket 46. The reference numeral 140 designates a lock member for fixing the safe 48 to the coin receiving and dispensing machine 1 and the reference numeral 141 designates a coin guide.

In the thus constituted coin collecting compartment 44, when the gate 26 is opened and a coin is fed via the chute 26*f*, the coin is received in the coin collecting basket 46. After all of the coins have been stored in the temporary storing cylinders 40*a*, 40*b*, 40*c*, 40*d*, 40*e*, 40*f*, if the coin acceptance instruction is input to the coin receiving and dispensing machine 1, the rotatable shaft 45 is rotated clockwise in FIG. 13 and the coins stored in the coin collecting basket 46 are collected, being guided by the coin guide 141, into the safe 48. On the other hand, if the cancel instruction is input to the coin receiving and dispensing machine 1, the rotatable shaft 45 is rotated counterclockwise in FIG. 13 and the coins stored in the coin collecting basket 46 are fed to the coin return chute 47 and returned to the coin dispensing compartment 43.

FIGS. 9 and 10 show the details of the drive mechanism for taking out the coins stored the temporarily storing cylinders 40*a*, 40*b*, 40*c*, 40*d*, 40*e*, 40*f* and collecting or returning the coins stored in the coin collecting basket 46 into the safe 48 or the coin collecting compartment 43.

Referring to FIGS. 9 and 10, on the left side of the front side plates 50 and the rear side plates 90, the drive mechanism is provided with a drive source 150 and a drive gear 152 integrally formed with a drive shaft 151 of the drive source 150 and a gear 153 is engaged with the drive gear 152. A pulley 154 is integrally and coaxially formed with the gear 153 and, as shown in FIG. 9, a belt 156 is engaged with the pulley 154 and a pulley 155 provided on the outer face of the left front side plates 50. Further, a pulley 157 is integrally and coaxially formed with the pulley 155 and a belt 159 is engaged with the pulley 157 and a pulley 158 integrally and coaxially formed with the rotatable shaft 54.

On the other hand, a group of speed change gears 160 are engaged with the gear 153 and cams 162 is provided on the opposite sides of the rear side plates 90 so as to be integrally formed with an output shaft 161 of the group of speed change gears 160 mounted on the pair of rear side plates at the opposite ends thereof. As shown in FIG. 10, each of the cams 162 has a concave portion and its lobe is formed symmetrically with respect to the horizontal line. A roller 163 is provided at one end of each of the L-shaped swing levers 76 and abuts against one of the cams 162. The swing lever 76 is swingably mounted on a lever shaft 164 provided on each of the rear side plates 90 and as described above, the other end thereof is engageable with the elevatable shaft 77, thereby to enable the elevatable shaft 77 to be moved in the vertical direction. The roller 163 engages with the concave portion of the cam 162 under the condition where the support plates 58*a*, 58*b*, 58*c*, 58*d*, 58*e*, 58*f* are positioned at their lowermost position.

Further, as shown in FIG. 10, a gear 165 is integrally formed with the output shaft 161 of the group of speed change gears 160 and engaged with a gear 166 engaged with a gear 166. A bevel gear 168 is integrally formed with a shaft of the gear 167 and a bevel gear 169 is engaged with the bevel gear 168. A gear 170 is integrally formed with a shaft of the gear 169 and a gear 171 integrally formed with the rotatable shaft 45 of the coin collecting basket 46 in the coin collecting compartment 44.

The thus constituted coin receiving and dispensing machine 1 operates as follows.

Coins deposited through the coin depositing opening 10 are fed to the take-in roller 13 one by one by the centrifugal force produced by the rotation of the disk 12 while being guided by the guide (not shown) and, further, fed to the coin discriminating and counting passage 14 by the take-in roller 13. The coins fed to the coin discriminating and counting passage 14 are transported by the first transporting endless belt 16, while accelerating the feed rate thereof. Then, their denominations and genuineness etc. are discriminated and their value is counted by the discriminating and counting sensor 23 and the results of the discrimination and the counting are input to the control unit (not shown) in the control mechanism 9. The numbers of the coins stored in the temporary storing cylinders 40*a*, 40*b*, 40*c*, 40*d*, 40*e*, 40*f* are stored in memory in the control unit of the control mechanism 9 and when the control unit judges that at least one of the temporary storing cylinders 40*a*, 40*b*, 40*c*, 40*d*, 40*e*, 40*f* is full of coins, it drives the gate opening and closing solenoid 26*c* to open the gate 26, whereby the coins to be stored in the temporarily storing cylinder 40*a*, 40*b*, 40*c*, 40*d*, 40*e*, 40*f* are collected via the chute 26*a* and the chute 26*f* into the coin collecting compartment 44. In this case, any preceding coin or following coin being transported with a smaller interval between itself and the coin to be collected than the interval between the first sensor 24 and the second sensor 25 is collected together with the coin to be collected into the coin collecting compartment 44.

The coins are further transported while being accelerated by the second transporting endless belt 18. The coins which have not been collected by the gate 26 are fed to the coin sorting passage 32 and fall into the coin sorting openings 34*a*, 34*b*, 34*c*, 34*d*, 34*e*, 34*f* in accordance with their diameters and are sorted in accordance with their denominations. Then, the sorted coins are fed via the sorting chutes 52*a*, 52*b*, 52*c*, 52*d*, 52*e*, 52*f* to the temporary storing cylinders 40*a*, 40*b*, 40*c*, 40*d*, 40*e*, 40*f* respectively in accordance with their denominations.

The control unit then displays the value of the received coins counted by the discriminating and counting sensor 23 on the display (not shown). When the operator judges that the coins may be accepted by the coin receiving and dispensing machine 1, as where the value displayed on the display agrees with that expected by the operator, the operator inputs the coin acceptance instruction to the coin receiving and dispensing machine 1.

When the coin acceptance instruction is input, the control unit drives the drive source 150 to rotate the drive shaft 151 counterclockwise in FIG. 9. As a result, the driving force is transmitted to the rotatable shaft 54 via the drive gear 152, the gear 153, the pulley 154, the belt 156, the pulley 155, the pulley 157, the belt 159 and the pulley 158 and the rotatable shaft 54 is rotated clockwise, whereby the take-out rollers 42*a*, 42*b*, 42*c*, 42*d*, 42*e*, 42*f* are rotated clockwise.

On the other hand, when the drive shaft 151 and the drive gear 152 are rotated counterclockwise in FIG. 9, the gear 153 is rotated clockwise and the output shaft 161 is rotated clockwise via the group of speed change gears 160. As a consequence, the pair of cams provided on the outer faces of the pair of the rear side plates 90 are rotated clockwise in FIG. 9 and counterclockwise in FIG. 10, whereby the pair of the swing levers 76, 76 are swung about the lever shafts 164 by the rollers 163 abutting against the lobes of the cams 163 so as to lift the elevatable shafts 77, 77. As a result, the roller mounting plate 73 lifts the pair of the guide rollers 75 along the slits 74 and also lifts the elevatable plate 69. In accordance with the lifting of the elevatable plate 69, the coil springs 72*a*, 72*b*, 72*c*, 72*d*, 72*e*, 72*f* secured to the pins 71*a*, 71*b*, 71*c*, 71*d*, 71*e*, 71*f* of the elevatable plate 69 are expanded, whereby the pulleys 67*a*, 67*b*, 67*c*, 67*d*, 67*e*, 67*f* engaged with the coil springs 72*a*, 72*b*, 72*c*, 72*d*, 72*e*, 72*f* are lifted and the support arms 62*a*, 62*b*, 62*c*, 62*d*, 62*e*, 62*f*, the blocks 64*a*, 64*b*, 64*c*, 64*d*, 64*e*, 64*f* and the blocks 66*a*, 66*b*, 66*c*, 66*d*, 66*e*, 66*f* are lifted along the fixed shafts 63*a*, 63*b*, 63*c*, 63*d*, 63*e*, 63*f*. Accordingly, the support plates 58*a*, 58*b*, 58*c*, 58*d*, 58*e*, 58*f* are respectively lifted within the temporary storing cylinders 40*a*, 40*b*, 40*c*, 40*d*, 40*e*, 40*f*.

Thus, since the support plates 58*a*, 58*b*, 58*c*, 58*d*, 58*e*, 58*f* supporting the coins on the upper faces thereof are lifted while the take-out rollers 42*a*, 42*b*, 42*c*, 42*d*, 42*e*, 42*f* are being rotated, the coins are fed one by one to the dispensation cylinders 41*a*, 41*b*, 41*c*, 41*d*, 41*e*, 41*f*. More specifically, referring to FIG. 7, the coins stored in the temporary storing cylinders 40*a*, 40*b*, 40*c*, 40*d*, 40*e*, 40*f* are taken out one by one by the take-out rollers 42*a*, 42*b*, 42*c*, 42*d*, 42*e*, 42*f* disposed above the temporary storing cylinders 40*a*, 40*b*, 40*c*, 40*d*, 40*e*, 40*f* rotating counterclockwise and fall into the dispensation cylinders 41*a*, 41*b*, 41*c*, 41*d*, 41*e*, 41*f*, being guided by the guide plates 83, to be stored therein in a stacked-up manner.

Although the elevatable shafts 77, 77, the roller mounting plate 73, the guide rollers 75 and the elevatable plate 69 are lifted continuously at a constant rate, since a predetermined time is required for taking out each coin by the take-out rollers 42*a*, 42*b*, 42*c*, 42*d*, 42*e*, 42*f*, if the support plates 58*a*, 58*b*, 58*c*, 58*d*, 58*e*, 58*f* should be lifted continuously at a constant rate, the take-out rollers 42*a*, 42*b*, 42*c*, 42*d*, 42*e*, 42*f* would not be able to take out the coins one by one. However, in this embodiment, although the support plates 58*a*, 58*b*, 58*c*, 58*d*, 58*e*, 58*f* are lifted together with the elevatable plate 69 etc., since each of the support plates 58*a*, 58*b*, 58*c*, 58*d*, 58*e*, 58*f* is lifted by the drive source 150 via one of the coil springs 72*a*, 72*b*, 72*c*, 72*d*, 72*e*, 72*f*, even if the elevatable shafts 77, 77, the roller mounting plate 73, the guide rollers 75, 75 and the elevatable plate 69 are lifted continuously at a constant rate, the coil springs 72*a*, 72*b*, 72*c*, 72*d*, 72*e*, 72*f* are expanded and the support plates 58*a*, 58*b*, 58*c*, 58*d*, 58*e*, 58*f* are not lifted and held at a predetermined position, while the take-out rollers 42*a*, 42*b*, 42*c*, 42*d*, 42*e*, 42*f* are taking out the coins, whereby it is possible to smoothly take out the coins from the temporary storing cylinders 40*a*, 40*b*, 40*c*, 40*d*, 40*e*, 40*f* to the dispensation cylinders 41*a*, 41*b*, 41*c*, 41*d*, 41*e*, 41*f*.

Simultaneously, since the output shaft 161 of the group of speed change gears 160 is rotated counterclockwise in FIG. 10, the gear 171 is rotated clockwise in FIG. 13 via the gears 165, 166, 167, the bevel gears 168, 169 and the gear 170 and the rotatable shaft 45 is rotated clockwise. As a result, the coin collecting basket 46 is turned to the right and the coins stored in the coin collecting basket 46 are collected into the safe 48, being guided by the coin guide 141.

On the contrary, when the operator judges that the coin receiving operation should be canceled as in the case where the value of the deposited coins counted by the discriminating and counting sensor 23 and displayed does not agree with that expected by the operator, and inputs the cancel instruction to the coin receiving and dispensing machine 1, the control unit (not shown) drives the drive source 150 and rotates the drive shaft 151 clockwise in FIG. 9. As a result, contrary to the case where the coin acceptance instruction is input, the take-out rollers 42*a*, 42*b*, 42*c*, 42*d*, 42*e*, 42*f* are rotated clockwise in FIG. 7 and counterclockwise in FIG. 9 and the cams 162 are rotated counterclockwise in FIG. 9 and clockwise in FIG. 10. In this case, although each of the rollers 163 abuts against the opposite lobe of the cam 162 from that in the case where the coin receiving instruction is input, since the lobe of the cams 162 are formed symmetrically with respect to the horizontal line, the swing levers 76, 76 are swung about the lever shafts 164 so as to lift the elevatable shafts 77, 77 similarly to the case where the coin receiving instruction is input. Therefore, the support plates 58*a*, 58*b*, 58*c*, 58*d*, 58*e*, 58*f* are lifted and the coins stored in the temporary storing cylinders 40*a*, 40*b*, 40*c*, 40*d*, 40*e*, 40*f* are taken out by the take-out rollers 42*a*, 42*b*, 42*c*, 42*d*, 42*e*, 42*f* rotating in the opposite direction to that in the case where the coin receiving instruction is input and returned to the coin dispensing compartment 43 via the first chute 78, the second chute 79 and the third chute 80.

Further, since the drive shaft 151 of the drive source 150 is rotated clockwise, the gear 171 is rotated counterclockwise in FIG. 13. As a result, the coin collecting basket 46 is turned to the left and the coins stored in the coin collecting basket 46 are returned to the coin dispensing compartment 43 via the coin return chute 47.

As described above, when the operation for taking out the coins stored in the temporary storing cylinders 40*a*, 40*b*, 40*c*, 40*d*, 40*e*, 40*f* has been completed, the control unit (not shown) drives the drive source 150 to rotate each of the rollers 163 until it abuts against the concave portion of one of the cams 162 for swinging the swing levers 76, 76. As a result, the pair of swing levers 76, 76 are swung about the lever shafts 164 in the opposite direction to that when the support plates 58*a*, 58*b*, 58*c*, 58*d*, 58*e*, 58*f* are lifted and the elevatable shafts 77, 77 are lowered. Then the roller mounting plate 73, the guide rollers 75, 75, and the elevatable plate 69 are lowered and the coil springs 72*a*, 72*b*, 72*c*, 72*d*, 72*e*, 72*f*, the pulleys 67*a*, 67*b*, 67*c*, 67*d*, 67*e*, 67*f* engaged with the coil springs 72*a*, 72*b*, 72*c*, 72*d*, 72*e*, 72*f*, the support arms 62*a*, 62*b*, 62*c*, 62*d*, 62*e*, 62*f*, the blocks 64*a*, 64*b*, 64*c*, 64*d*, 64*e*, 64*f* and the blocks 66*a*, 66*b*, 66*c*, 66*d*, 66*e*, 66*f* are lowered together along the fixed shafts 63*a*, 63*b*, 63*c*, 63*d*, 63*e*, 63*f*. Accordingly, the support plates 58*a*, 58*b*, 58*c*, 58*d*, 58*e*, 58*f* are lowered to their lowermost position within the temporary storing cylinders 40*a*, 40*b*, 40*c*, 40*d*, 40*e*, 40*f* respectively.

In the case of dispensing the thus stored coins in the temporarily storing cylinders 40*a*, 40*b*, 40*c*, 40*d*, 40*e*, 40*f*, the control unit drives the dispensing drive source 112 to rotate the drive pulley 114 fixed to the drive shaft 113 of the dispensing drive source 112 counterclockwise in FIGS. 7 and 10 and the rotation thereof is transmitted via the belt 115 to the pulley 117 integrally formed with the rotatable shaft 106, whereby the cam 107 is rotated counterclockwise.

As a result, the projection 105 of the cam 107 engages with the lower end of the coin push plate 104 and pushes the coin push plate 104 against the biasing force of the first tension spring 109 to the left in FIG. 7. However, since the upper edge of the coin push plate 104 is positioned below each of the bottom plates 94*a*, 94*b*, 94*c*, 94*d*, 94*e*, 94*f*, even if the coin push plate 104 is push to the left, the coins cannot be dispensed. Therefore, the control unit turns on only the solenoids 98 of the dispensation cylinders 41*a*, 41*b*, 41*c*, 41*d*, 41*e*, 41*f* from which the coins should be dispensed and the plunger of each of the solenoids 98 turned on is pulled up to lift the coin push plate holding member 102 so that the upper edge of the coin push plate 104 is positioned above the bottom plates 94*a*, 94*b*, 94*c*, 94*d*, 94*e*, 94*f* by a distance not greater than the thickness of a coin stored in the dispensation cylinders 41*a*, 41*b*, 41*c*, 41*d*, 41*e*, 41*f* whose solenoid 98 is turned on. Thus, only the coin push plates 104 of the dispensation cylinders 41*a*, 41*b*, 41*c*, 41*d*, 41*e*, 41*f* are pushed along the openings formed in the bottom plates 94*a*, 94*b*, 94*c*, 94*d*, 94*f* into the coin dispensing openings 95*a*, 95*b*, 95*c*, 95*d*, 95*e*, 95*f* and the coins are dispensed one by one from only the dispensation cylinders 41*a*, 41*b* 41*c*, 41*d*, 41*e*, 41*f* from which the coins should be dispensed to the coin dispensing compartment 43.

As described above, when the coin dispensing operation has been completed, the control unit retracts the projection 105 of the cam 105 downwardly and releases the engagement between itself and the coin push plate 104. As a result, the coin push plate 104 is drawn back to the right in FIG. 7 by the tensile force of the first tension spring 109. Further, the control unit turns off the solenoids 98 of the dispensation cylinders 41*a*, 41*b*, 41*c*, 41*d*, 41*e*, 41*f* from which the coins have been dispensed, whereby the coin push plates 104 which has been lifted are lowered by the tensile force of the second tension spring 111 and positioned at the waiting position below the bottom plates 94*a*, 94*b*, 94*c*, 94*d*, 94*e*, 94*f*.

Figure 14:
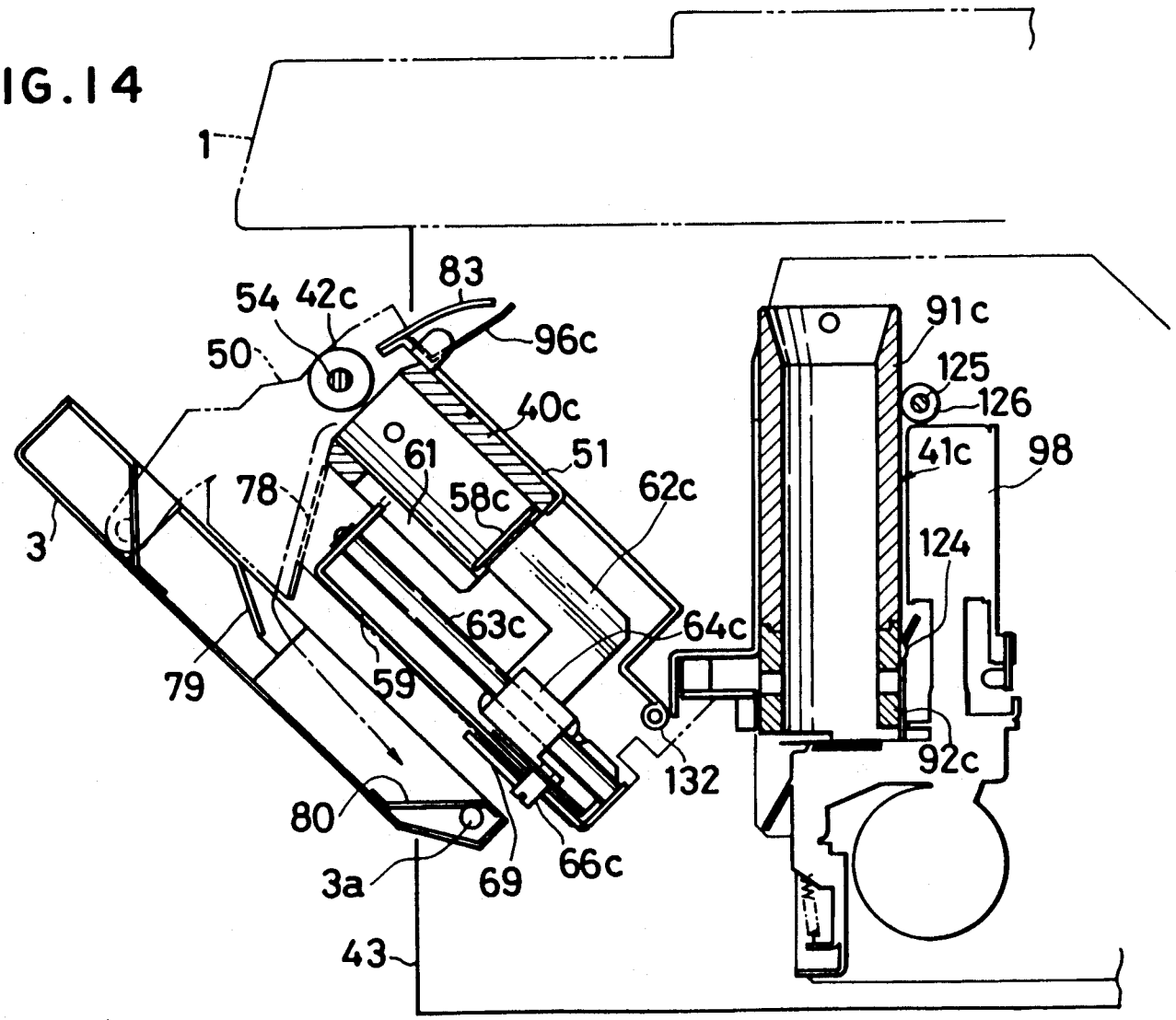
FIG. 14 is a schematic drawing showing a cross-sectional drawing of an essential part taken on line V—V of FIG. 1.

Moreover, in cases where the coins jam in at least one of the temporary storing cylinders 40*a*, 40*b*, 40*c*, 40*d*, 40*e*, 40*f* or the maintenance is carried out on the temporary storing cylinders 40*a*, 40*b*, 40*c*, 40*d*, 40*e*, 40*f* and portions in the vicinity thereof, as shown in FIGS. 10, 11 and 14, the front door 3 is pivoted about the pivot shaft 3*a* and opened forwardly. As a result, the front side plates 50 are pulled forwardly via the connecting plates 82 and the engagement between the projections 133 of the front side plates 50 and the engaging members 134 of the rear side plates 90 are released. Accordingly, the front side plates 50 become pivotable forwardly about the shaft 132 and the stopper plates 137 can be also pivoted about the shaft 136 provided on the pair of the rear side plates 90, whereby the front side plates 90 are forwardly pivoted until the shafts 138 provided on the pair of front side plates 50 are moved forwardly along the slots 138 of the stopper plates 137 and reaches the front end of the slots 138, and the front side plates 50 are held by the stopper plates 137 so as to be forwardly inclined at a predetermined angle. Under these conditions, since the locking of the lock plates 87 by the lock members 89 is released the hooks 87*a* of the lock plates 87 are projected into the slits 74 and are engageable with the elevatable shafts 77, 77.

Further, since front door 3 is opened and the front side plates 50 are moved forwardly, the first frame 51, the second frame 59, the separation chutes 52*a*, 52*b*, 52*c*, 52*d*, 52*e*, 52*f*, the temporary storing cylinders 40*a*, 40*b*, 40*c*, 40*d*, 40*e*, 40*f*, the take-out rollers 42*a*, 42*b*, 42*c*, 42*d*, 42*e*, 42*f*, the coin supporting mechanism 53, the photo sensors 56*a*, 56*b*, the plate-like springs 96*a*, 96*b*, 96*c*, 96*d*, 96*e*, the guide plate 83, the first return chute 78, the engaging mechanism 84 and the sensors 56*c*, 56*d* are pivoted forwardly about the shaft 3*a* or the shaft 132 and held so as to be forwardly inclined at predetermined angles, respectively.

Therefore, since the temporary storing cylinders 40*a*, 40*b*, 40*c*, 40*d*, 40*e*, 40*f* and the upper portion thereof are exposed to the outside, it is possible to easily carry out maintenance on the temporary storing cylinders 40*a*, 40*b*, 40*c*, 40*d*, 40*e*, 40*f* and the portions in the vicinity thereof in such a case where the coins jam for some reason in one or more of the temporary storing cylinders 40*a*, 40*b*, 40*c*, 40*d*, 40*e*, 40*f*. Further, since the guide plate 83 and the plate-like springs 96*a*, 96*b*, 96*c*, 96*d*, 96*e* are moved forwardly, it is possible to easily carry out maintenance on the dispensation cylinders 41*a*, 41*b*, 41*c*, 41*d*, 41*e*, 41*f*.

Moreover, in the case where it is necessary to collect the coins stored in the temporary storing cylinders 40*a*, 40*b*, 40*c*, 40*d*, 40*e*, 40*f*, the coins can be collected via the first return chute 78, the second return chute 79 and the third return chute 80 into the coin collecting compartment 43 by manually lifting the suppport plates 58*a*, 58*b*, 58*c*, 58*d*, 58*e*, 58*f* and rotating the take-out rollers 42*a*, 42*b*, 42*c*, 42*d*, 42*e*, 42*f*. Furthermore, if the elevatable shafts 77, 77 are engaged with the hooks 87*a* of the lock plates 87, it is possible to easily carry out maintenance and when the front door 3 is closed, since the engagement between the elevatable shafts 77, 77 and the hooks 87*a* is automatically released by the lock members 89, the operation can be immediately started again.

As described in detail, according to this embodiment, in the case where at least one of the dispensation cylinders 41*a*, 41*b*, 41*c*, 41*d*, 41*e*, 41*f* is full of coins, since the coins to be stored in the dispensation cylinder full of coins are collected by the gate 26 into the coin collecting compartment 44 without feeding them to the coin sorting passage 32, jamming of coins in the coin sorting passage 32 and erroneous sorting of coins can be prevented without fail. Moreover, it is possible to prevent the erroneously sorted coins from being fed into the wrong temporary storing cylinders 40*a*, 40*b*, 40*c*, 40*d*, 40*e*, 40*f* so that jamming of the coins and dispensing of coins of the wrong denominations from the dispensation cylinders 41*a*, 41*b*, 41*c*, 41*d*, 41*e*, 41*f* can be avoided.

Further, since the dispensation cylinders 41*a*, 41*b*, 41*c*, 41*d*, 41*e*, 41*f* are arranged behind the temporary storing cylinders 40*a*, 40*b*, 40*c*, 40*d*, 40*e*, 40*f*, a larger amount of coins can be stored in the coin receiving and dispensing machine 1 without increasing the height of the machine 1 and a sufficient amount of coins can be received and dispensed.. Particularly, it is possible to provide a coin receiving and dispensing machine 1 suitable for desktop use or in other situations where the machine height has to be severely restricted Furthermore, according to the above described embodiment, by rotating the drive shaft 151 of one drive source 150 in the opposite direction, since the coins stored in the temporary cylinders 40*a*, 40*b*, 40*c*, 40*d*, 40*e*, 40*f* can be fed into the dispensation cylinders 41*a*, 41*b*, 41*c*, 41*d*, 41*e*, 41*f* and the coins stored in the coin collecting basket 46 are collected into the safe 48, or the coins stored in the temporary cylinders 40*a*, 40*b*, 40*c*, 40*d*, 40*e*, 40*f* can be collected into the coin dispensing compartment 43 and the coins stored in the coin collecting basket 46 are collected into the coin dispensing compartment 43, it is possible to provide a coin receiving and dispensing machine 1 with a simple structure.

In addition, since the support plates 58*a*, 58*b*, 58*c*, 58*d*, 58*e*, 58*f* are lifted or lowered by the drive source 150 via the expansible coil springs 72*a*, 72*b*, 72*c*, 72*d*, 72*e*, 72*f* connecting the elevatable plate 69 lifted or lowered by the drive source 150 and the support arms 62*a*, 62*b*, 62*c*, 62*d*, 62*e*, 62*f* supporting the support plates 58*a*, 58*b*, 58*c*, 58*d*, 58*e*, 58*f*, even if the elevatable plate 69 is driven continuously at a constant rate, it is possible to take out the coins one by one from the temporary storing cylinders 40*a*, 40*b*, 40*c*, 40*d*, 40*e*, 40*f* without fail.

As described in detail with reference to the preferred embodiment, according to the present invention, it is possible to provide a coins receiving and dispensing machine capable of effectively preventing coins from jamming and being erroneously sorted.

The present invention has thus been shown and described with reference to the specific embodiment. However, it should be noted that the present invention is in no way limited to the details of the described arrangements but changes and modifications may be made without departing from the scope of the appended claims.

For example, in the above describe embodiment, although the support plates 58*a*, 58*b*, 58*c*, 58*d*, 58*e*, 58*f* of the temporary storing cylinders 40*a*, 40*b*, 40*c*, 40*d*, 40*e*, 40*f* are lifted or lowered by the drive source 150 via the expansible coil springs 72*a*, 72*b*, 72*c*, 72*d*, 72*e*, 72*f* connecting the elevatable plate 69 lifted or lowered by the drive source 150 and the support arms 62*a*, 62*b*, 62*c*, 62*d*, 62*e*, 62*f* supporting the support plates 58*a*, 58*b*, 58*c*, 58*d*, 58*e*, 58*f*, it is possible to move the elevatable plate 69 continuously at a constant rate by connecting the drive source 150 and the support arms 62*a*, 62*b*, 62*c*, 62*d*, 62*e*, 62*f* via the elevatable plate 69 and providing an expansible elastic means between the support arms 62*a*, 62*b*, 62*c*, 62*d*, 62*e*, 62*f* and the support plates 58*a*, 58*b*, 58*c*, 58*d*, 58*e*, 58*f*.

Further, in the above described embodiment, although the received coins freely fall via the sorting chutes 52*a*, 52*b*, 52*c*, 52*d*, 52*e*, 52*f* into the temporary storing cylinders 40*a*, 40*b*, 40*c*, 40*d*, 40*e*, 40*f*, it is possible to feed the received coins by the take-out rollers 42*a*, 42*b*, 42*c*, 42*d*, 42*e*, 42*f* into the temporary storing cylinders 40*a*, 40*b*, 40*c*, 40*d*, 40*e*, 40*f* by rotating the take-out rollers 42*a*, 42*b*, 42*c*, 42*d*, 42*e*, 42*f* during the entire coin receiving operation. In this case, if the take-out rollers 42*a*, 42*b*, 42*c*, 42*d*, 42*e*, 42*f* are driven by the drive source 150 for lifting or lowering the support plates 58*a*, 58*b*, 58*c*, 58*d*, 58*e*, 58*f* similarly as in the above described embodiment, means such as an electromagnetic clutch for preventing the power of the drive source 150 from being transmitted to the support plate 58*a*, 58*b*, 58*c*, 58*d*, 58*e*, 58*f* during the coin receiving operation may be provided.

Moreover, it is possible to further provide means for vibrating the elevatable plate 69 by the power of the drive source 150 so that the support plates 58*a*, 58*b*, 58*c*, 58*d*, 58*e*, 58*f* are vibrated during the coin receiving operation and the coins fed into the temporary storing cylinders 40*a*, 40*b*, 40*c*, 40*d*, 40*e*, 40*f* can be prevented from standing erect or jamming.

Further, means for collecting the coins into the coin collecting compartment 44 is not limited to the gate 26 employed in the above described embodiment and gates having other structure or various means such as a shutter can be employed.

I claim:

1. A coin receiving and dispensing machine comprising discriminating and counting means for discriminating at least the denominations and genuineness of deposited coins and counting their value, coin sorting means for sorting the deposited coins in accordance with their denominations, a plurality of temporary storing means for receiving the coins sorted by said coin sorting means from an upper opening thereof and temporarily storing the received coins as stacked separately in accordance with their denominations and a plurality of dispensing coins storing means for receiving and storing the coins stored in said plurality of temporary storing means as dispensing coins separately in accordance with their denominations, said coin receiving and dispensing machine further comprising coin collecting means for, in the case where it is judged based upon the result of the discrimination and counting made by said discriminating and counting means that at least one of said dispensing coin storing means is full of coins, collecting the coins that would normally be stored in said dispensing coin storing means, said coin collecting means being disposed between said discriminating and counting means and said coin sorting means, and each pair of said temporary storing means and said dispensing coin storing means which store the same denomination of coins being arranged laterally of each other so that a top of the dispensing coin storing means is positioned above a bottom of the temporary storing means.

2. A coin receiving and dispensing machine in accordance with claim 1, wherein each of said plurality of the temporary storing means includes support plate means for holding the received coins thereon and said support plate means is able to be moved vertically by said drive means.

3. A coin receiving and dispensing machine in accordance with claim 1, wherein said support plate means is moved vertically by said drive means via expansible elastic means.

4. A coin receiving and dispensing machine in accordance with claim 1 wherein said coin collecting means comprises a gate capable of being opened and closed.

5. A coin receiving and dispensing machine in accordance with claim 1 wherein each pair of said temporary storing means and said dispensing coin storing means which store the same denomination of coins are arranged laterally of each other so that a top of the dispensing coin means is positioned above a bottom of the temporary storing means.

6. A coin receiving and dispensing machine in accordance with claim 5, wherein each of said plurality of the temporary storing means includes support plate means for holding the received coins thereon and said support plate means is able to be moved vertically by said drive means.

7. A coin receiving and dispensing machine in accordance with claim 6, wherein said support plate means is moved vertically by said drive means via expansible elastic means.

8. A coin receiving and dispensing machine as claimed in claim 4, wherein each of said plurality of the temporary storing means includes support plate means for holding the received coins thereon and said support plate means is able to be moved vertically by said drive means.

* * * * *